US012478134B2

(12) United States Patent
Bock et al.

(10) Patent No.: US 12,478,134 B2
(45) Date of Patent: Nov. 25, 2025

(54) ARTICLE OF FOOTWEAR

(71) Applicant: PUMA SE, Herzogenaurach (DE)

(72) Inventors: Markus Bock, Herzogenaurach (DE); Yihyun Lim, Somerville, MA (US); Hunmin Koh, Seoul (KR); Yasaman Tahouni, Horgenzell (DE); Will Walker, Oakland, CA (US); Federico Casalegno, San Francisco, CA (US)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 17/076,377

(22) Filed: Oct. 21, 2020

(65) Prior Publication Data

US 2021/0112917 A1 Apr. 22, 2021

Related U.S. Application Data

(60) Provisional application No. 62/923,909, filed on Oct. 21, 2019.

(51) Int. Cl.
*A43B 13/18* (2006.01)
*A43B 13/22* (2006.01)

(52) U.S. Cl.
CPC ..... *A43B 13/181* (2013.01); *A43B 13/223* (2013.01)

(58) Field of Classification Search
CPC ..... A43B 13/20; A43B 13/181; A43B 13/223; A43B 13/146; A43B 13/125; A43B 13/04
USPC ..... 36/103
See application file for complete search history.

(56) References Cited

U.S. PATENT DOCUMENTS

| | | | | |
|---|---|---|---|---|
| 2,983,056 | A * | 5/1961 | Murawski | A43B 13/206 36/32 R |
| 3,005,272 | A * | 10/1961 | Shelare | A43B 13/20 36/32 R |
| 3,469,576 | A | 9/1969 | Smith | |
| 3,573,155 | A | 3/1971 | Mitchell | |
| 3,629,051 | A | 12/1971 | Mitchell | |
| 4,100,686 | A | 7/1978 | Sgarlato et al. | |
| 4,112,599 | A | 9/1978 | Krippelz | |
| D256,067 | S | 7/1980 | Hagg et al. | |
| 4,235,026 | A | 11/1980 | Plagenhoef | |

(Continued)

FOREIGN PATENT DOCUMENTS

| | | |
|---|---|---|
| AT | 1378549 T | 4/2021 |
| AT | 1486244 T | 5/2022 |

(Continued)

OTHER PUBLICATIONS

US D748,382 S, 02/2016, Galway et al. (withdrawn)

(Continued)

*Primary Examiner* — Haley A Smith
(74) *Attorney, Agent, or Firm* — Quarles & Brady LLP

(57) ABSTRACT

An article of footwear comprising an upper defining a forefoot region, a midfoot region, and a heel region of the article of footwear, and a sole structure coupled with the upper. The sole structure includes a midsole and an outsole coupled with a bottom surface of the midsole. A void structure is provided within the sole structure, which includes a plurality of voids defining channels that extend through an entire width of the sole structure. The void structure includes a plurality of first voids in the shape of a vertical lemniscate and a plurality of second voids in the shape of a horizontal lemniscate.

22 Claims, 29 Drawing Sheets

(56) References Cited

U.S. PATENT DOCUMENTS

D265,017 S 6/1982 Vermonet
D272,963 S 3/1984 Muller et al.
4,753,021 A * 6/1988 Cohen ..... A43B 13/206 36/28
4,779,359 A 10/1988 Famolare, Jr.
D298,582 S 11/1988 Caire
D304,520 S 11/1989 Clark
D307,971 S 5/1990 Maccano et al.
4,942,679 A 7/1990 Brandon et al.
4,944,099 A 7/1990 Davis
D311,989 S 11/1990 Parker et al.
5,042,176 A 8/1991 Rudy
5,084,987 A 2/1992 Flemming
D324,762 S 3/1992 Hatfield
5,134,790 A 8/1992 Woitschaetzke et al.
D329,528 S 9/1992 Hatfield
5,152,081 A 10/1992 Hallenbeck et al.
D330,629 S 11/1992 Bramani
5,197,206 A 3/1993 Shorten
5,197,207 A 3/1993 Shorten
D337,650 S 7/1993 Thomas, III et al.
D340,797 S 11/1993 Pallera et al.
5,313,717 A 5/1994 Allen et al.
5,329,705 A 7/1994 Grim et al.
D350,222 S 9/1994 Hase
5,378,223 A 1/1995 Grim et al.
5,383,290 A 1/1995 Grim
D356,438 S 3/1995 Opie et al.
D365,920 S 1/1996 Schneider
5,607,749 A 3/1997 Strumor
D386,589 S 11/1997 Cass
D389,991 S 2/1998 Elliott
D390,349 S 2/1998 Murai et al.
5,952,065 A 9/1999 Mitchell et al.
D414,920 S 10/1999 Cahill
D415,610 S 10/1999 Cahill
D415,876 S 11/1999 Cahill
5,979,078 A 11/1999 McLaughlin
D423,199 S 4/2000 Cahill
D429,874 S 8/2000 Gumbert
D431,346 S 10/2000 Birkenstock
D444,620 S 7/2001 Della Valle
D446,002 S 8/2001 Leong et al.
D460,852 S 7/2002 Daudier
6,467,197 B1 10/2002 Mitsui et al.
6,558,784 B1 5/2003 Norton et al.
6,618,959 B1 9/2003 Sussmann
6,647,646 B2 11/2003 Mitsui et al.
D483,932 S 12/2003 Cooper
6,670,029 B2 12/2003 Norton et al.
6,763,611 B1 * 7/2004 Fusco ..... A43B 13/181 36/27
6,763,615 B2 7/2004 Mitsui et al.
D494,343 S 8/2004 Morris
6,782,640 B2 8/2004 Westin
D496,149 S 9/2004 Belley et al.
6,817,113 B2 11/2004 Pan
6,843,000 B1 * 1/2005 Park ..... B29D 35/14 36/27
6,848,200 B1 2/2005 Westin
6,883,252 B2 4/2005 Cagner
6,920,707 B1 7/2005 Greene et al.
6,951,066 B2 10/2005 Snow
6,957,504 B2 10/2005 Morris
D512,208 S 12/2005 Kubo et al.
D515,297 S 2/2006 Acheson
7,086,179 B2 8/2006 Dojan et al.
7,086,180 B2 8/2006 Dojan et al.
7,096,605 B1 8/2006 Kozo et al.
7,100,310 B2 9/2006 Foxen et al.
7,141,131 B2 11/2006 Foxen et al.
7,153,560 B2 12/2006 Hofmann
7,181,866 B2 2/2007 Braunschweiler
7,254,906 B2 8/2007 Morris et al.
D549,934 S 9/2007 Horne et al.
D551,831 S 10/2007 Romero-Sanchez
D556,982 S 12/2007 Harper et al.
D560,883 S 2/2008 McClaskie
D561,433 S 2/2008 McClaskie
D571,085 S 6/2008 McClaskie
7,401,420 B2 7/2008 Dojan et al.
D576,780 S 9/2008 Jolicoeur
D586,090 S 2/2009 Turner et al.
7,484,318 B2 2/2009 Finkelstein
D596,384 S 7/2009 Andersen et al.
7,555,848 B2 7/2009 Aveni et al.
7,556,846 B2 7/2009 Dojan et al.
7,559,107 B2 7/2009 Dojan et al.
7,562,469 B2 7/2009 Dojan
D597,293 S 8/2009 Banik et al.
D601,333 S 10/2009 McClaskie
7,665,230 B2 2/2010 Dojan et al.
7,676,955 B2 3/2010 Dojan et al.
7,676,956 B2 3/2010 Dojan et al.
7,685,741 B2 3/2010 Friedman
D616,183 S 5/2010 Skaja
D617,540 S 6/2010 McClaskie
D624,291 S 9/2010 Henderson
7,805,859 B2 10/2010 Finkelstein
D631,237 S 1/2011 Genuin et al.
D631,646 S 2/2011 Muller
D633,286 S 3/2011 Skaja
D633,287 S 3/2011 Skaja
D636,571 S 4/2011 Avar
8,074,377 B2 12/2011 Nishiwaki et al.
8,112,909 B2 2/2012 Kubo et al.
8,122,614 B2 2/2012 Sussmann
8,176,657 B2 5/2012 Schinlder et al.
8,296,969 B2 10/2012 Granger et al.
D671,305 S 11/2012 Escobar
D671,306 S 11/2012 Tzenos
8,312,644 B2 11/2012 Peikert et al.
8,321,984 B2 12/2012 Dojan et al.
8,356,429 B2 1/2013 Eder et al.
8,418,379 B2 4/2013 Nishiwaki et al.
8,429,835 B2 4/2013 Dojan et al.
D693,553 S 11/2013 McClaskie
8,572,866 B2 11/2013 Dojan et al.
8,578,535 B2 11/2013 Dojan et al.
D696,501 S 12/2013 Miner
D696,502 S 12/2013 Miner
D696,503 S 12/2013 Miner
8,657,979 B2 2/2014 Dojan et al.
8,671,591 B2 3/2014 Brown
8,745,892 B2 6/2014 Polegato Moretti
D709,680 S 7/2014 Herath
8,789,298 B2 7/2014 Eder et al.
D711,081 S 8/2014 Miner
D713,623 S 9/2014 Lo
8,961,844 B2 2/2015 Baghdadi et al.
D731,763 S 6/2015 Solstad
D734,600 S 7/2015 Gargiulo
9,078,493 B2 7/2015 Bradford
D739,131 S 9/2015 Del Biondi
9,125,454 B2 9/2015 De Roode et al.
D740,003 S 10/2015 Herath
D740,004 S 10/2015 Hoellmueller et al.
D746,559 S 1/2016 Besanceney et al.
9,241,536 B2 1/2016 Smaldone et al.
D753,381 S 4/2016 Ostapenko
9,320,317 B2 4/2016 Bernhard et al.
D756,085 S 5/2016 Spring
D756,620 S 5/2016 Boys
9,351,534 B2 5/2016 Peikert et al.
D758,056 S 6/2016 Galway et al.
D759,358 S 6/2016 Cullen
9,402,439 B2 8/2016 Cross et al.
D765,361 S 9/2016 Johnsongriffin
D765,362 S 9/2016 Kuerbis
D767,263 S 9/2016 Reiser
9,456,656 B2 10/2016 Cross
9,486,036 B1 11/2016 Douglas
D773,161 S 12/2016 Teteriatnikov
D773,790 S 12/2016 Raysse

(56) References Cited

U.S. PATENT DOCUMENTS

D773,791 S 12/2016 Raysse
9,510,640 B2 12/2016 Bier et al.
D776,410 S 1/2017 Galway et al.
9,538,811 B2 1/2017 Cross
9,549,590 B2 * 1/2017 Cross ..... A43B 13/141
9,554,620 B2 1/2017 Cross et al.
9,554,622 B2 1/2017 Cross
9,554,624 B2 1/2017 Cross
9,572,404 B2 2/2017 Dojan et al.
D781,543 S 3/2017 Raysse
9,585,435 B2 3/2017 Bier et al.
D783,247 S 4/2017 McMillan
9,610,746 B2 4/2017 Wardlaw et al.
9,682,522 B2 6/2017 Baghdadi et al.
9,687,041 B2 6/2017 Peikert et al.
D790,817 S 7/2017 Perkins et al.
D791,452 S 7/2017 Dombrow
D792,067 S 7/2017 Raysse
D793,680 S 8/2017 Lee
D793,688 S 8/2017 Avar et al.
D794,289 S 8/2017 Kanata
9,717,301 B2 8/2017 Peikert et al.
9,717,304 B2 8/2017 Bernhard et al.
9,723,895 B2 8/2017 Schaefer et al.
D797,418 S 9/2017 Lee et al.
D798,553 S 10/2017 Lee
D799,183 S 10/2017 Weeks
9,775,403 B2 10/2017 Bernhard et al.
9,775,769 B2 10/2017 Brown et al.
9,781,970 B2 10/2017 Wardlaw et al.
9,781,974 B2 10/2017 Reinhardt et al.
9,788,598 B2 10/2017 Reinhardt et al.
9,788,606 B2 10/2017 Reinhardt et al.
9,795,186 B2 10/2017 Reinhardt et al.
9,820,528 B2 11/2017 Reinhardt et al.
9,820,532 B2 11/2017 Cross et al.
D804,159 S 12/2017 Allemann et al.
9,849,645 B2 12/2017 Wardlaw et al.
D808,143 S 1/2018 Negri
9,854,869 B2 1/2018 Nordstrom
9,861,159 B2 1/2018 Kohatsu et al.
D809,252 S 2/2018 Brunner et al.
D809,253 S 2/2018 Brunner et al.
D809,755 S 2/2018 Stavseng et al.
D809,756 S 2/2018 Stavseng et al.
D809,761 S 2/2018 Parrett
D810,407 S 2/2018 DeAlmeida
D811,062 S 2/2018 Teague
9,884,947 B2 2/2018 Prissok et al.
D813,503 S 3/2018 Brunner et al.
D813,504 S 3/2018 Brunner et al.
D813,508 S 3/2018 Weeks
9,926,423 B2 3/2018 Baghdadi
D814,752 S 4/2018 Ormsby
9,930,928 B2 4/2018 Whiteman et al.
9,961,961 B2 5/2018 Smith
9,968,157 B2 5/2018 Wardlaw et al.
9,968,160 B2 5/2018 Peyton
D821,070 S 6/2018 Brunner et al.
D822,957 S 7/2018 Brunner et al.
10,039,342 B2 8/2018 Reinhardt et al.
10,051,914 B2 8/2018 Cross et al.
10,051,917 B2 8/2018 Dojan et al.
D828,686 S 9/2018 Hoellmueller et al.
D831,315 S 10/2018 Mahoney
D831,317 S 10/2018 Jenkins et al.
10,098,411 B2 10/2018 Hoffer et al.
10,098,412 B2 10/2018 Hoffer et al.
10,111,494 B2 10/2018 Cross
D836,893 S 1/2019 Bischoff et al.
10,182,612 B2 1/2019 Bunnell et al.
D840,135 S 2/2019 Dombrow
D840,136 S 2/2019 Herath et al.
D840,137 S 2/2019 Herath et al.
10,226,099 B2 3/2019 Bischoff
10,227,467 B2 3/2019 Baghdadi
D846,255 S 4/2019 Khalife
D846,256 S 4/2019 Khalife
10,259,183 B2 4/2019 Wardlaw et al.
10,271,615 B2 4/2019 Cross
D847,475 S 5/2019 Khalife
D847,480 S 5/2019 Khalife
10,278,448 B2 5/2019 Cross
10,285,471 B2 5/2019 Cross
D850,766 S 6/2019 Girard et al.
D851,889 S 6/2019 Dobson et al.
D852,475 S 7/2019 Hoellmueller
D852,476 S 7/2019 Hartmann
D853,691 S 7/2019 Coonrod et al.
D853,699 S 7/2019 Coonrod et al.
10,433,616 B2 10/2019 Takeshita et al.
10,470,521 B2 11/2019 Iuchi et al.
10,645,998 B2 5/2020 Shaffer et al.
10,721,992 B2 7/2020 Bernhard et al.
10,786,039 B2 9/2020 Kohatsu et al.
D900,444 S 11/2020 Brunner et al.
D900,462 S 11/2020 Brunner et al.
D901,866 S 11/2020 Brunner et al.
D923,300 S 6/2021 Brunner et al.
11,076,656 B2 * 8/2021 Kormann ..... A43B 23/0245
11,147,344 B2 10/2021 Bernhard et al.
2002/0071946 A1 6/2002 Norton et al.
2003/0097767 A1 5/2003 Perkinson
2003/0208925 A1 11/2003 Pan
2004/0148805 A1 8/2004 Morris
2004/0154189 A1 8/2004 Wang
2005/0252038 A1 11/2005 Braunschweiler
2006/0026863 A1 2/2006 Liu
2006/0234012 A1 10/2006 Wang
2008/0127513 A1 6/2008 Schinlder et al.
2008/0148599 A1 6/2008 Collins
2009/0064542 A1 3/2009 Figueroa
2009/0172971 A1 7/2009 Peikert et al.
2010/0242309 A1 9/2010 McCann
2011/0047720 A1 3/2011 Maranan et al.
2011/0197468 A1 8/2011 Kubo et al.
2011/0252670 A1 10/2011 Smith
2013/0055599 A1 3/2013 Peikert et al.
2013/0059116 A1 3/2013 Peikert et al.
2013/0145653 A1 6/2013 Bradford
2013/0160223 A1 6/2013 Bier et al.
2013/0233477 A1 9/2013 Bier et al.
2013/0291409 A1 11/2013 Reinhardt et al.
2013/0312284 A1 11/2013 Berend et al.
2014/0033574 A1 2/2014 Wan
2014/0086504 A1 3/2014 Arai
2014/0151918 A1 6/2014 Hartmann
2014/0196308 A1 7/2014 Baratta et al.
2014/0208610 A1 7/2014 Dirsa et al.
2014/0223776 A1 8/2014 Wardlaw et al.
2014/0223777 A1 8/2014 Whiteman et al.
2014/0259745 A1 9/2014 Vaglio
2015/0096203 A1 4/2015 Brown et al.
2015/0272272 A1 10/2015 Scofield
2016/0007676 A1 1/2016 Leimer et al.
2016/0025343 A1 * 1/2016 Bertoldi ..... B23K 26/38 60/722
2016/0037859 A1 2/2016 Smith et al.
2016/0044992 A1 2/2016 Reinhardt et al.
2016/0120260 A1 5/2016 Hansen et al.
2016/0227876 A1 8/2016 Le et al.
2016/0242502 A1 * 8/2016 Spanks ..... A43B 13/181
2016/0278481 A1 9/2016 Le et al.
2016/0295955 A1 10/2016 Wardlaw et al.
2016/0324260 A1 * 11/2016 Guyan ..... A43B 13/20
2016/0345665 A1 12/2016 Kohatsu et al.
2016/0374428 A1 12/2016 Kormann et al.
2017/0006958 A1 1/2017 Jeong
2017/0105478 A1 4/2017 Cross et al.
2017/0172251 A1 6/2017 Douglas
2017/0245581 A1 8/2017 McFarland et al.
2017/0245582 A1 8/2017 Green et al.
2017/0253710 A1 9/2017 Smith et al.
2017/0258178 A1 9/2017 Cross et al.

(56) References Cited

U.S. PATENT DOCUMENTS

| | | | |
|---|---|---|---|
| 2017/0258180 | A1 | 9/2017 | Cross et al. |
| 2017/0259474 | A1 | 9/2017 | Holmes et al. |
| 2017/0341325 | A1 | 11/2017 | Le et al. |
| 2017/0354568 | A1 | 12/2017 | Brown et al. |
| 2018/0000197 | A1 | 1/2018 | Wardlaw et al. |
| 2018/0027922 | A1 | 2/2018 | Orand |
| 2018/0035755 | A1 | 2/2018 | Reinhardt et al. |
| 2018/0049509 | A1 | 2/2018 | Zwick et al. |
| 2018/0064210 | A1 | 3/2018 | Turner et al. |
| 2018/0077997 | A1 | 3/2018 | Hoffer et al. |
| 2018/0077998 | A1 | 3/2018 | Nordstrom |
| 2018/0092432 | A1 | 4/2018 | Hoffer et al. |
| 2018/0098602 | A1 | 4/2018 | Kohatsu et al. |
| 2018/0100049 | A1 | 4/2018 | Prissok et al. |
| 2018/0103719 | A1 | 4/2018 | Chen |
| 2018/0103725 | A1 | 4/2018 | Chen |
| 2018/0110292 | A1 | 4/2018 | Beers et al. |
| 2018/0116327 | A9 | 5/2018 | McFarland et al. |
| 2018/0125156 | A1 | 5/2018 | Bray, Jr. |
| 2018/0125157 | A1 | 5/2018 | Bray, Jr. |
| 2018/0132487 | A1 | 5/2018 | Kormann et al. |
| 2018/0153264 | A1 | 6/2018 | Amos et al. |
| 2018/0154598 | A1 | 6/2018 | Kurtz et al. |
| 2018/0199667 | A1 | 7/2018 | Wang |
| 2018/0206591 | A1 | 7/2018 | Whiteman et al. |
| 2018/0206599 | A1 | 7/2018 | Amos et al. |
| 2018/0235310 | A1 | 8/2018 | Wardlaw et al. |
| 2018/0289108 | A1 | 10/2018 | Hoffer et al. |
| 2018/0289109 | A1 | 10/2018 | Beers et al. |
| 2018/0303198 | A1 | 10/2018 | Reinhardt et al. |
| 2018/0325217 | A1 | 11/2018 | Dojan et al. |
| 2018/0338569 | A1 | 11/2018 | Cross et al. |
| 2018/0352900 | A1 | 12/2018 | Hartmann et al. |
| 2019/0082782 | A1 | 3/2019 | Bunnell et al. |
| 2019/0126580 | A1 | 5/2019 | Paulson et al. |
| 2019/0133251 | A1 | 5/2019 | Hartmann et al. |
| 2019/0150564 | A1 | 5/2019 | Bischoff |
| 2019/0216167 | A1 | 7/2019 | Hoffer et al. |
| 2019/0216168 | A1 | 7/2019 | Hoffer et al. |
| 2019/0223539 | A1 | 7/2019 | Hoffer et al. |
| 2019/0223550 | A1 | 7/2019 | Levy |
| 2019/0223551 | A1 | 7/2019 | Hoffer et al. |
| 2019/0281921 | A1 | 9/2019 | Bray, Jr. |
| 2019/0291371 | A1 | 9/2019 | Wardlaw et al. |
| 2022/0031017 | A1 | 2/2022 | Heitz et al. |
| 2022/0031018 | A1 | 2/2022 | Bernhard et al. |
| 2022/0203611 | A1 | 6/2022 | Bernhard et al. |
| 2022/0240626 | A1 | 8/2022 | Bernhard et al. |

FOREIGN PATENT DOCUMENTS

| | | | |
|---|---|---|---|
| AU | 367102 | S | 2/2016 |
| AU | 367132 | S | 2/2016 |
| AU | 201616565 | S | 12/2016 |
| AU | 201911227 | S | 4/2019 |
| AU | 201911228 | S | 4/2019 |
| BR | 302016005366 | S1 | 10/2017 |
| BR | 302018055276 | S1 | 2/2019 |
| BR | 302018002647 | S1 | 8/2019 |
| BR | 302019001134 | S1 | 8/2019 |
| CN | 1285779 | A | 2/2001 |
| CN | 1334054 | A | 2/2002 |
| CN | 1653982 | A | 8/2005 |
| CN | 2790218 | Y | 6/2006 |
| CN | 101299941 | A | 11/2008 |
| CN | 201226862 | Y | 4/2009 |
| CN | 101537675 | A | 9/2009 |
| CN | 201813947 | U | 5/2011 |
| CN | 102273769 | A | 12/2011 |
| CN | 102481746 | A | 5/2012 |
| CN | 104256997 | A | 1/2015 |
| CN | 105025745 | A | 11/2015 |
| CN | 105476176 | A | 4/2016 |
| CN | 105595519 | A | 5/2016 |
| CN | 304114391 | S | 4/2017 |
| CN | 106939097 | A | 7/2017 |
| CN | 107048591 | A | 8/2017 |
| CN | 206808782 | U | 12/2017 |
| DE | 3440206 | A1 | 5/1985 |
| DE | 202005017043 | U1 | 3/2007 |
| DE | 50308731 | | 1/2008 |
| DE | 202012010878 | U1 | 1/2013 |
| DE | 202012010879 | U1 | 1/2013 |
| DE | 202014003016 | U1 | 5/2014 |
| DE | 102015118251 | A1 | 4/2017 |
| DE | 502016014813 | | 5/2022 |
| DE | 502019010599 | | 3/2024 |
| DE | 502019010635 | | 3/2024 |
| DM | 102274006 | | 8/2018 |
| DM | 103418013 | | 9/2018 |
| EM | 001286116-0005 | | 7/2011 |
| EM | 002219956-0024 | | 5/2013 |
| EM | 002772764-0015 | | 2/2016 |
| EM | 003165984-0005 | | 6/2016 |
| EM | 003039619-0034 | | 7/2016 |
| EM | 003315555-0001 | | 8/2016 |
| EM | 003316389-0001 | | 8/2016 |
| EM | 003330174-0003 | | 8/2016 |
| EM | 003344076-0002 | | 9/2016 |
| EM | 003362672-0001 | | 9/2016 |
| EM | 003718311-0019 | | 2/2017 |
| EM | 003761089-0028 | | 5/2017 |
| EM | 004363935-0008 | | 10/2017 |
| EM | 004386571-0002 | | 10/2017 |
| EM | 004366326-0001 | | 11/2017 |
| EM | 003761113-0025 | | 12/2017 |
| EM | 004675411-0006 | | 1/2018 |
| EM | 004543882-0008 | | 5/2018 |
| EM | 005243227-0002 | | 5/2018 |
| EM | 005260023-0003 | | 5/2018 |
| EM | 005278413-0002 | | 5/2018 |
| EM | 005320371-0002 | | 7/2018 |
| EM | 005841939-0004 | | 12/2018 |
| EM | 003649060-0005 | | 1/2019 |
| EM | 004352755-0004 | | 1/2019 |
| EM | 005612025-0001 | | 1/2019 |
| EM | 004812501-0004 | | 2/2019 |
| EM | 005191004-0010 | | 2/2019 |
| EM | 006335345-0003 | | 4/2019 |
| EM | 003522580-0029 | | 6/2019 |
| EM | 003649540-0001 | | 7/2019 |
| EP | 1021965 | A2 | 7/2000 |
| EP | 1164884 | A1 | 1/2002 |
| EP | 1033924 | B1 | 9/2003 |
| EP | 1563750 | A1 | 8/2005 |
| EP | 1991078 | A1 | 11/2008 |
| EP | 2103420 | A2 | 9/2009 |
| EP | 1979401 | B1 | 9/2010 |
| EP | 2490561 | A1 | 8/2012 |
| EP | 1991728 | B1 | 1/2013 |
| EP | 2611323 | A1 | 7/2013 |
| EP | 2490564 | B1 | 1/2014 |
| EP | 2786670 | A1 | 10/2014 |
| EP | 2724635 | B1 | 3/2015 |
| EP | 1796493 | B1 | 4/2015 |
| EP | 2676562 | B1 | 4/2015 |
| EP | 2611321 | B1 | 8/2015 |
| EP | 2984956 | A1 | 2/2016 |
| EP | 3001922 | A1 | 4/2016 |
| EP | 3001923 | A1 | 4/2016 |
| EP | 3027377 | A1 | 6/2016 |
| EP | 3041892 | A1 | 7/2016 |
| EP | 2197311 | B1 | 8/2016 |
| EP | 2649896 | B1 | 10/2016 |
| EP | 3078287 | A1 | 10/2016 |
| EP | 3114954 | A1 | 1/2017 |
| EP | 3114955 | A1 | 1/2017 |
| EP | 3114956 | A1 | 1/2017 |
| EP | 3114959 | A1 | 1/2017 |
| EP | 2713794 | B1 | 4/2017 |
| EP | 3186306 | A1 | 7/2017 |
| EP | 3200640 | A1 | 8/2017 |
| EP | 2467037 | B1 | 10/2017 |
| EP | 2872309 | B1 | 11/2017 |

(56) References Cited

FOREIGN PATENT DOCUMENTS

| | | | |
|---|---|---|---|
| EP | 3267818 | A1 | 1/2018 |
| EP | 3267820 | A1 | 1/2018 |
| EP | 3267822 | A1 | 1/2018 |
| EP | 3267823 | A1 | 1/2018 |
| EP | 3267824 | A2 | 1/2018 |
| EP | 3267826 | A1 | 1/2018 |
| EP | 2910141 | B1 | 2/2018 |
| EP | 3289907 | A1 | 3/2018 |
| EP | 3302143 | A1 | 4/2018 |
| EP | 3308663 | A1 | 4/2018 |
| EP | 3318150 | A1 | 5/2018 |
| EP | 3338581 | A1 | 6/2018 |
| EP | 3346862 | A1 | 7/2018 |
| EP | 2845504 | B1 | 8/2018 |
| EP | 3352607 | A1 | 8/2018 |
| EP | 3352608 | A1 | 8/2018 |
| EP | 3352610 | A1 | 8/2018 |
| EP | 3352611 | A1 | 8/2018 |
| EP | 3352612 | A1 | 8/2018 |
| EP | 3352615 | A1 | 8/2018 |
| EP | 3338984 | A3 | 9/2018 |
| EP | 2948012 | B1 | 10/2018 |
| EP | 3381311 | A1 | 10/2018 |
| EP | 3391767 | A1 | 10/2018 |
| EP | 3412164 | A1 | 12/2018 |
| EP | 3416516 | A1 | 12/2018 |
| EP | 2611322 | B1 | 1/2019 |
| EP | 3423621 | A1 | 1/2019 |
| EP | 3434128 | A1 | 1/2019 |
| EP | 3010362 | B1 | 4/2019 |
| EP | 3466291 | A1 | 4/2019 |
| EP | 3248770 | B1 | 5/2019 |
| EP | 3348160 | B1 | 5/2019 |
| EP | 3476237 | A1 | 5/2019 |
| EP | 3484320 | A1 | 5/2019 |
| EP | 3284362 | B1 | 7/2019 |
| EP | 3386334 | B1 | 7/2019 |
| EP | 3534743 | A1 | 9/2019 |
| GB | 350493 | A | 6/1931 |
| GB | 80830100001000 | S | 8/2014 |
| GB | 80865610001000 | S | 11/2015 |
| GB | 80865620001000 | S | 11/2015 |
| GB | 80913230001000 | S | 5/2016 |
| GB | 80908830006000 | S | 11/2016 |
| GB | 80913220001000 | S | 11/2016 |
| GB | 80913240001000 | S | 11/2016 |
| GB | 80929060001000 | S | 3/2017 |
| GB | 81031770001000 | S | 12/2018 |
| GB | 82000680001000 | S | 5/2019 |
| GB | 82052540002000 | S | 1/2020 |
| IT | 202200034259 | T2 | 4/2022 |
| JP | 2002526126 | A | 8/2002 |
| JP | 2010158511 | A | 7/2010 |
| JP | 5465814 | B1 | 4/2014 |
| JP | 2016202903 | A | 12/2016 |
| JP | 1576023 | S | 5/2017 |
| JP | 1587379 | S | 10/2017 |
| JP | 1587380 | S | 10/2017 |
| JP | 1587383 | S | 10/2017 |
| JP | 1587384 | S | 10/2017 |
| JP | 1587413 | S | 10/2017 |
| JP | 1597010 | S | 2/2018 |
| JP | 1600181 | S | 3/2018 |
| JP | 1658933 | S | 5/2020 |
| JP | 1674560 | S | 12/2020 |
| JP | 1685374 | S | 5/2021 |
| JP | 1689233 | S | 7/2021 |
| KR | 101162721 | B1 | 7/2012 |
| KR | 101567716 | B1 | 11/2015 |
| KR | 086562001 | S1 | 9/2016 |
| KR | 090883001 | S1 | 5/2017 |
| KR | 090883002 | S1 | 5/2017 |
| KR | 090883003 | S1 | 5/2017 |
| KR | 1020210106456 | A | 8/2021 |
| KR | 1020210108386 | A | 9/2021 |
| MX | 49996 | S | 7/2017 |
| MX | 49997 | S | 7/2017 |
| MX | 50693 | S | 9/2017 |
| MX | 53296 | S | 9/2018 |
| MX | 59399 | S | 1/2021 |
| MX | 60398 | S | 4/2021 |
| MX | 60717 | S | 6/2021 |
| MX | 62125 | S | 10/2021 |
| MX | 387951 | B | 12/2021 |
| NO | 0865610001 | S | 11/2015 |
| NO | 0865620001 | S | 11/2015 |
| NO | 0908830007 | S | 11/2016 |
| NO | 0913220001 | S | 11/2016 |
| NO | 0913230001 | S | 11/2016 |
| NO | 0913240001 | S | 11/2016 |
| NO | 0929060001 | S | 3/2017 |
| NO | 3297485 | B1 | 3/2018 |
| NO | 1031770001 | S | 12/2018 |
| NO | 2000680002 | S | 5/2019 |
| NO | 2052540001 | S | 1/2020 |
| RU | 2786607 | C1 | 12/2022 |
| RU | 2791498 | C2 | 3/2023 |
| TH | 2101002977 | A | 6/2022 |
| TH | 2101003051 | A | 6/2022 |
| WO | 2006112622 | A1 | 10/2006 |
| WO | 20100084367 | A1 | 10/2006 |
| WO | 2010021517 | A2 | 2/2010 |
| WO | 083010 | S | 2/2014 |
| WO | 2015017088 | A1 | 2/2015 |
| WO | 086561 | S | 11/2015 |
| WO | 086562 | S | 11/2015 |
| WO | 2000051458 | A1 | 11/2015 |
| WO | 2016030026 | A1 | 3/2016 |
| WO | 2016030333 | A1 | 3/2016 |
| WO | 2016053443 | A1 | 4/2016 |
| WO | 2016144406 | A1 | 9/2016 |
| WO | 2016144407 | A1 | 9/2016 |
| WO | 2016144408 | A1 | 9/2016 |
| WO | 2016144409 | A1 | 9/2016 |
| WO | 2016144410 | A1 | 9/2016 |
| WO | 2016144413 | A1 | 9/2016 |
| WO | 090883 | S | 11/2016 |
| WO | 091322 | S | 11/2016 |
| WO | 091323 | S | 11/2016 |
| WO | 091324 | S | 11/2016 |
| WO | 2016191109 | A1 | 12/2016 |
| WO | 092906 | S | 3/2017 |
| WO | 2017042127 | A1 | 3/2017 |
| WO | 2017053650 | A1 | 3/2017 |
| WO | 2017053654 | A1 | 3/2017 |
| WO | 2017053658 | A1 | 3/2017 |
| WO | 2017053665 | A1 | 3/2017 |
| WO | 2017053669 | A1 | 3/2017 |
| WO | 2017053674 | A1 | 3/2017 |
| WO | 090883004 | S1 | 5/2017 |
| WO | 090883005 | S1 | 5/2017 |
| WO | 090883006 | S1 | 5/2017 |
| WO | 090883007 | S1 | 5/2017 |
| WO | 090883008 | S1 | 5/2017 |
| WO | 091322001 | S1 | 5/2017 |
| WO | 091324001 | S1 | 5/2017 |
| WO | 2017097315 | A1 | 6/2017 |
| WO | 2017142857 | A1 | 8/2017 |
| WO | 2017151496 | A1 | 9/2017 |
| WO | 2018011030 | A1 | 1/2018 |
| WO | 2018083676 | A1 | 5/2018 |
| WO | 2018099833 | A1 | 6/2018 |
| WO | 2018103811 | A1 | 6/2018 |
| WO | 2018169535 | A1 | 9/2018 |
| WO | 2018169537 | A1 | 9/2018 |
| WO | 2018192262 | A1 | 10/2018 |
| WO | 103177 | S | 12/2018 |
| WO | 2019029781 | A1 | 2/2019 |
| WO | 2019073607 | A1 | 4/2019 |
| WO | 200068 | S | 5/2019 |
| WO | 2019101339 | A1 | 5/2019 |
| WO | 2019150492 | A1 | 8/2019 |
| WO | 205254 | S | 1/2020 |
| WO | 2020016105 | A1 | 1/2020 |

(56) References Cited

FOREIGN PATENT DOCUMENTS

| | | | |
|---|---|---|---|
| WO | 103177002 | S1 | 4/2020 |
| WO | 2020193034 | A1 | 10/2020 |
| WO | 205254001 | S1 | 1/2021 |
| WO | 205254002 | S1 | 1/2021 |

OTHER PUBLICATIONS

International Search Report of related International Application No. PCT/EP2018/061934 mailed Jan. 17, 2019, 6 pages.
Written Opinion of related International Application No. PCT/EP2018/061934 mailed Jan. 17, 2019, 7 pages.
International Preliminary Report on Patentability (Form IPEA/409) of related International Application No. PCT/EP2018/061934, mailed Jan. 3, 2020, 24 pages.
International Search Report of related International Application No. PCT/EP2018/061935, mailed Jan. 18, 2019, 7 pages.
Written Opinion of related International Application No. PCT/EP2018/061935, mailed Jan. 18, 2019, 6 pages.
International Preliminary Report on Patentability (Form IPEA/409) of related International Application No. PCT/EP2018/061935, mailed Jul. 6, 2020, 20 pages.
First Office Action from related Chinese Patent Application No. 201880093277_X dated Nov. 26, 2021 (14 pages) including English translation.
Office Action from related Japanese Patent Application No. 2020-562609 dated Dec. 21, 2021 (11 pages) including English translation.
Bicycling Catalog 39 Giant Phase 2 Road Shoe <https://www.camdenbikes.com/> [online] [retrieved on Jul. 19, 2019] (3 pages).
Bicycling Catalog 39 <https://www.berkshirebikeandboard.com/> [online] [retrieved on Jul. 19, 2019] (4 pages).
Hot pressing nfilm TPU film for bonding synthetic leather and mesh fabric together on shoes upper <https://www.alibaba.com/?from_http=1> [online] [retrieved on Jul. 19, 2019] (5 pages).
"The History of On (Running)", https://blog.finishline.com, 2022, Retrieved from the Internet: URL: https://blog.finishline.com/the-history-of-on-running/ [Retrieved Jun. 18, 2024].
Law, Brandon: "On Cloudsurfer 7 Review", https://runningshoeguru.com, Apr. 6, 2023, Retrieved from the Internet: URL: https://www.runningshoesguru.com/reviews/road/on-cloudsurfer-7-review/ [Retrieved Jun. 18, 2024].
Lassen, Kristin: "On Cloudflyer 4 Review", https://runningshoeguru.com, May 7, 2023, Retrieved from the Internet: URL: https://www.runningshoesguru.com/reviews/road/on-cloudflyer-4-review/ [Retrieved Jun. 18, 2024].
"History of On Running & On Cloud Shoes", https://blog.jdsports.com, 2022, Retrieved from the Internet: URL: https://blog.jdsports.com/history-of-on-running-on-cloud-shoes/ [Retrieved Jun. 18, 2024].
RoadTrailRun: "2019 On Running Previews: Cloudswift & Cloudstratus", https://youtube.com, Nov. 29, 2018, Retrieved from the Internet: URL: https://www.youtube.com/watch?v=4D259Gb2NmE [Retrieved Jun. 18, 2024].
On: "On | Cloudrock Waterproof—our first lightweight hiking shoe made for speed", https://youtube.com, Jul. 18, 2019, Retrieved from the Internet: URL: https://www.youtube.com/watch?app=desktop&v=JqS75kvmPls&vl=it [Retrieved Jun. 18, 2024].
Baham, Ryan: "On Cloud X Review", https://outdoorgearlab.com, Feb. 19, 2020, Retrieved from the Internet: URL: https://www.outdoorgearlab.com/reviews/shoes-and-boots/running-shoes-men/on-cloud-x [Retrieved Jun. 18, 2024].

* cited by examiner

ARTICLE OF FOOTWEAR

CROSS REFERENCE TO RELATED APPLICATIONS

This application claims priority to U.S. Provisional Application No. 62/923,909, filed on Oct. 21, 2019, the contents of which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Disclosure

The present disclosure relates generally to an article of footwear with a sole structure having voids with auxetic properties, which allows for programmable deforming or collapsing of various portions or regions of the sole structure to create a controlled spring-like or dampening effect for a wearer.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity.

The upper generally extends upward from the sole and defines an interior cavity that completely or partially encases a foot. In most cases, the upper extends over instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper may comprise a wide variety of materials, which may be chosen based on one or more intended uses of the shoe. The upper may also include portions comprising varying materials specific to a particular area of the upper. For example, added stability may be desirable at a front of the upper or adjacent a heel region to provide a higher degree of resistance or rigidity. In contrast, other portions of a shoe may include a soft woven textile to provide an area with stretch-resistance, flexibility, air-permeability, or moisture-wicking properties.

However, while many currently available shoes have varying features related to the above-noted properties, many shoes have sole structures that suffer from a lack of dampening features. Still further, many athletic shoes, especially running shoes and basketball shoes, lack cushioning qualities that allow for intended or programmable deformation of a midsole while running or engaging in strenuous athletic activities.

Therefore, articles of footwear having sole structures that include alternative cushioning features are desired. These and other deficiencies with the prior art are outlined in the following disclosure.

SUMMARY

A number of advantages of the articles of footwear described herein will be apparent to those having ordinary skill in the art. For example, various void structures defined within a sole structure can allow for programmable deformation of a midsole based on the placement and arrangement of voids comprising the void structures. The void structures may be provided in combination with features along an outsole, which may aid in enhanced cushioning during running or other strenuous activities. Still further, alternative void structure configurations as described herein may be utilized to achieve some of the benefits of the midsoles specifically shown and described. The various elements and combination of elements within the articles of footwear described herein add varying athletic benefits to the shoe, such as dampening, spring-like effects, or pronation support.

An article of footwear, as described herein, may have various configurations. The article of footwear may include an upper defining a forefoot region, a midfoot region, and a heel region of the article of footwear, and a sole structure coupled with the upper. The sole structure includes a midsole and an outsole coupled with a bottom surface of the midsole. A void structure is provided within the sole structure, the void structure comprising a plurality of voids, which comprise channels that extend through an entire width of the sole structure. The void structure includes a plurality of first voids having a first void characteristic and a plurality of second voids having a second void characteristic, the first void characteristic being different than the second void characteristic.

In some embodiments, the sole structure further includes a plurality of third voids having a third void characteristic, the third void characteristic being different than the first void characteristic and the second void characteristic. In some embodiments, a shape of the first void is the same as a shape of the second void, the first void characteristic is an orientation of the first void, and the second void characteristic is an orientation of the second void, and the orientation of the first void is offset 90 degrees from the orientation of the second void. In some embodiments, the shape of the first void and the shape of the second void is a lemniscate. In some embodiments, the sole structure further includes a plurality of third voids having the shape of a circle. In some embodiments, the article of footwear further includes a plurality of grooves along an underside of the sole structure. In some embodiments, the first void characteristic is a size of the first void and the second void characteristic is a size of the second void, and the size of the first void is different than the size of the second void. In some embodiments, at least one of the plurality of first voids is larger than at least one of the plurality of the second voids, and the plurality of first voids is located within a heel region of the sole structure and the plurality of second voids is located in the midfoot region of the sole structure.

In some embodiments, an article of footwear includes an upper defining a forefoot region, a midfoot region, and a heel region, and a sole structure coupled with the upper, the sole structure comprising a midsole and an outsole coupled with a bottom surface of the midsole. A void structure is provided within the sole structure, the void structure comprising a plurality of voids, which comprise channels that extend through an entire width of the sole structure. The void structure includes a plurality of first voids in the shape of a vertical lemniscate and a plurality of second voids in the shape of a horizontal lemniscate.

In some embodiments, the void structure further includes a plurality of third voids in the shape of circles. In some embodiments, the plurality of first voids and the plurality of second voids define a first column of voids and a second column of voids that is disposed adjacent to the first column of voids. The first column of voids includes one of the plurality of first voids disposed above one of the plurality of second voids, and the second column of voids includes one of the plurality of second voids disposed above one of the plurality of first voids. In some embodiments, the plurality of first voids are in the shape of vertical lemniscates, and the plurality of second voids are in the shape of horizontal lemniscates.

In some embodiments, the void structure further includes a plurality of third voids in the shape of circles, and the first column of voids includes one of the plurality of third voids disposed below the one of the plurality of second voids. In some embodiments, the plurality of first voids and the plurality of second voids are relatively smaller in the forefoot region of the sole structure than in the midfoot region of the sole structure. In some embodiments, the article of footwear further includes a plurality of grooves or notches cutout within the sole structure along a top or bottom side thereof. In some embodiments, the plurality of first voids are larger than the plurality of second voids. In some embodiments, the plurality of first voids and the plurality of second voids define between 10 and 40 columns of voids.

In some embodiments, an article of footwear includes an upper defining a forefoot region, a midfoot region, and a heel region, and a sole structure coupled with the upper, the sole structure comprising a midsole and an outsole coupled with a bottom surface of the midsole. A void structure is provided within the sole structure, the void structure comprising a plurality of voids, which comprise channels that extend through an entire width of the sole structure. The void structure includes a plurality of first voids and a plurality of second voids, the first voids and the second voids each being symmetric about at least two axes. In some embodiments, the plurality of first voids and the plurality of second voids are disposed in rows and columns. In some embodiments, the plurality of first voids and the plurality of second voids form an auxetic structure.

Other aspects of the articles of footwear described herein, including features and advantages thereof, will become apparent to one of ordinary skill in the art upon examination of the figures and detailed description herein. Therefore, all such aspects of the articles of footwear are intended to be included in the detailed description and this summary.

DETAILED DESCRIPTION OF THE DRAWINGS

The following discussion and accompanying figures disclose various embodiments or configurations of a shoe having an upper and a sole structure. Although embodiments are disclosed with reference to a sports shoe, such as a running shoe, tennis shoe, basketball shoe, etc., concepts associated with embodiments of the shoe may be applied to a wide range of footwear and footwear styles, including basketball shoes, cross-training shoes, football shoes, golf shoes, hiking shoes, hiking boots, ski and snowboard boots, soccer shoes and cleats, walking shoes, and track cleats, for example. Concepts of the shoe may also be applied to articles of footwear that are considered non-athletic, including dress shoes, sandals, loafers, slippers, and heels.

The term "about," as used herein, refers to variations in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The present disclosure is directed to an article of footwear or specific components of the article of footwear, such as an upper or a sole structure. The upper may comprise a knitted component, a woven textile, a non-woven textile, leather, mesh, suede, or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, or other suitable knitting operations. The knit textile may have a plain knit structure, a mesh knit structure, or a rib knit structure, for example. Woven textiles include, but are not limited to, textiles formed by way of any of the numerous weave forms, such as plain weave, twill weave, satin weave, dobbin weave, jacquard weave, double weaves, or double cloth weaves, for example. Non-woven textiles include textiles made by air-laid or spun-laid methods, for example. The upper may comprise a variety of materials, such as a first yarn, a second yarn, or a third yarn, which may have varying properties or varying visual characteristics.

Figure 1:
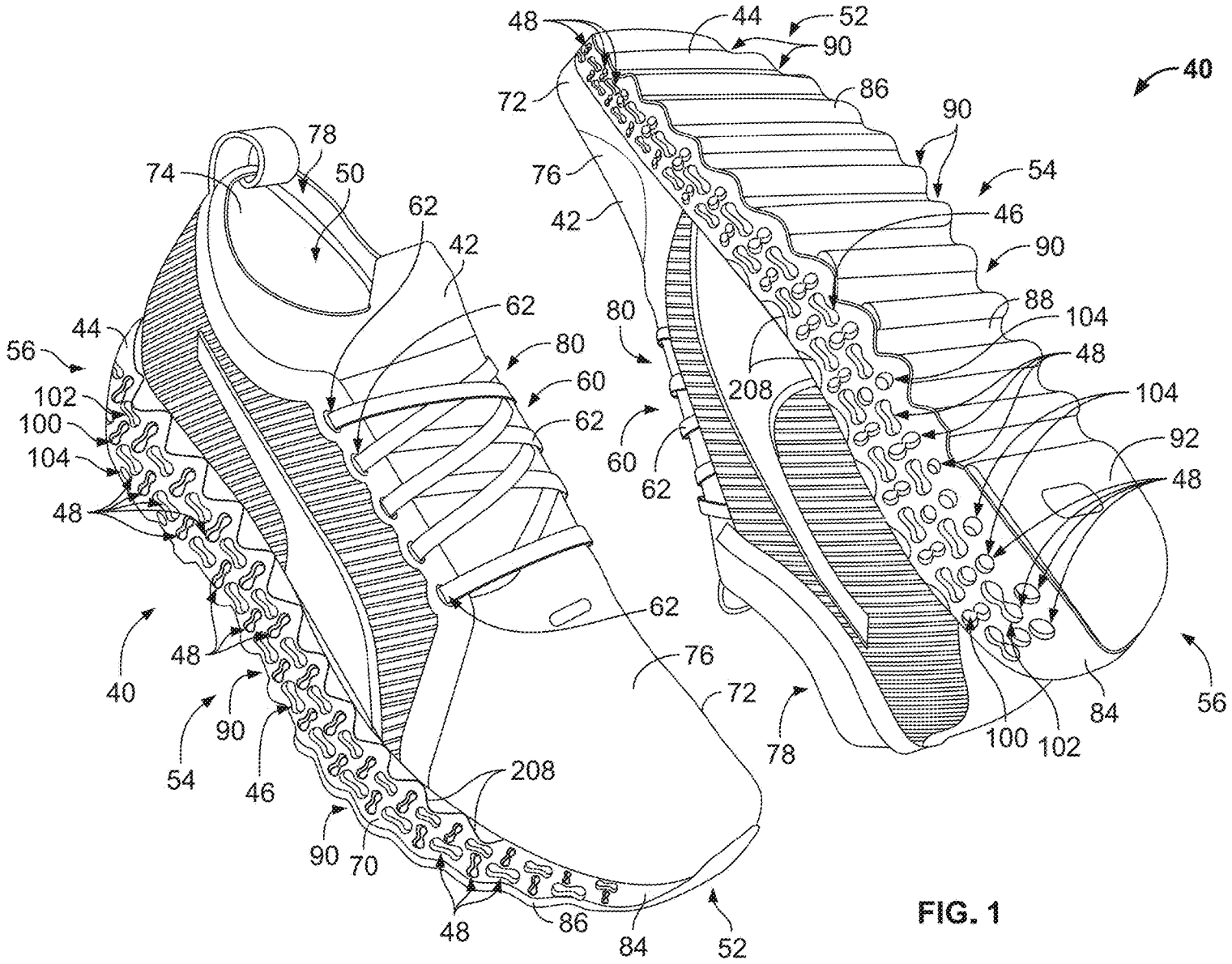
FIG. 1 is a perspective view of a pair of shoes that each include an upper and a sole structure having void structures, as discussed herein.

FIG. 1 depicts an exemplary embodiment of a pair of articles of footwear 40 configured as a left shoe and a right shoe, each of the articles of footwear 40 including an upper 42 and a sole structure 44. The sole structure 44 includes a void structure 46 comprising a plurality of voids 48, the voids 48 defining a pattern that provides for enhanced cushioning or programmable deformation of the sole structure 44 in accordance with the present disclosure. The upper 42 is attached to the sole structure 44 and together with the sole structure 44 defines an interior cavity 50 into which a foot of a user may be inserted. For reference, each of the shoes 40 defines a forefoot region 52, a midfoot region 54, and a heel region 56 (see FIG. 9).

Figure 9:
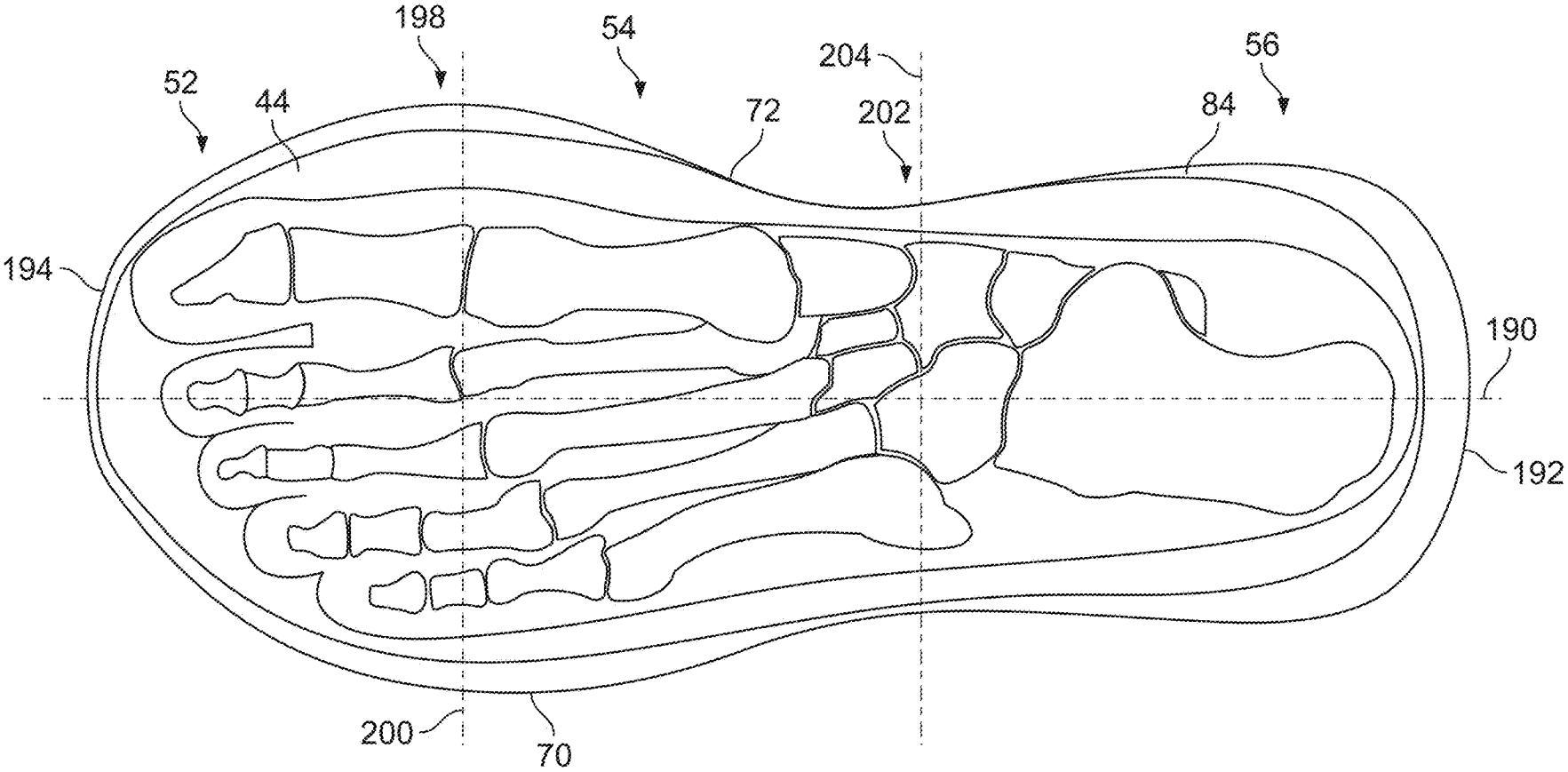
FIG. 9 is a schematic view of a sole structure that illustrates various portions of a foot overlaid upon the sole structure.

Referring to FIGS. 1 and 9, the forefoot region 52 generally corresponds with portions of the shoes 40 that encase portions of the foot that include the toes, the ball of the foot, and joints connecting the metatarsals with the toes or phalanges. The midfoot region 54 is proximate and adjoining the forefoot region 52, and generally corresponds with portions of the article of footwear 40 that encase the arch of a foot, along with the bridge of a foot. The heel region 56 is proximate and adjoining the midfoot region 54 and generally corresponds with portions of the article of footwear 40 that encase rear portions of the foot, including the heel or calcaneus bone, the ankle, or the Achilles tendon. While the present disclosure relates to a left shoe and a right shoe that are substantially the same, in some embodiments there may be differences between a left shoe and a right shoe other than the left/right configuration. Further, in some embodiments, a left shoe may include one or more additional elements that a right shoe does not include, or vice versa.

Referring specifically to the right shoe 40 of FIG. 1, the upper 42 is shown disposed above and coupled with the sole structure 44. The upper 42 could be formed conventionally from multiple elements, e.g., textiles, polymer foam, polymer sheets, leather, or synthetic leather, which are joined through bonding or stitching at a seam. In some embodiments, the upper 42 is formed from a knitted structure or knitted components. In various embodiments, a knitted component may incorporate various types of yarn that may provide different properties to an upper. For example, an upper mesh layer may be warp knit, while a mesh backing layer may comprise a circular knit. In some embodiments, various layers of the upper 42 are heat pressed together so as to bond the various layers of the upper 42.

With reference to the material(s) that comprise the upper 42, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 42.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In some embodiments, the properties associated with an upper, e.g., a stitch type, a yarn type, or characteristics associated with different stitch types or yarn types, such as elasticity, aesthetic appearance, thickness, air permeability, or scuff-resistance, may be varied.

Still referring to FIG. 1, the articles of footwear 40 also include a tightening system 60 that includes a lace 62 and a plurality of eyelets 64. The tightening system 60 may allow a user to modify dimensions of the upper 42, e.g., to tighten or loosen portions of the upper 42, around a foot as desired by the wearer. In other embodiments, the tightening system 60 may be a hook-and-loop fastening system, such as Velcro®. For example, in some embodiments, the tightening system 60 may include one or more hook-and-loop fastening straps. In some embodiments, the tightening system 60 may be another laceless fastening system known in the art. In still further embodiments, the tightening system 60 may include a different manual lacing system or an automatic lacing system, such as the lacing system described in U.S. patent application Ser. No. 16/392,470, filed on Apr. 23, 2019, which is hereby incorporated by reference in its entirety.

Referring to FIG. 1, the articles of footwear 40 each define a lateral side 70 and a medial side 72, and the lace 62 extends from the lateral side 70 to the medial side. When a user is wearing the shoes, the lateral side 70 corresponds with an outside-facing portion of the article of footwear 40 while the medial side 72 corresponds with an inside-facing portion of the article of footwear 40. As such, the left shoe 40 and the right shoe 40 have opposing lateral sides and medial sides, such that the medial sides are closest to one another when a user is wearing the shoes, while the lateral sides are defined as the sides that are farthest from one another while the shoes are being worn. The medial side 72 and the lateral side 70 adjoin one another at opposing, distal ends of the article of footwear 40.

Still referring to FIG. 1, the upper 42 extends along the lateral side 70 and the medial side 72, and across the forefoot region 52, the midfoot region 54, and the heel region 56 to house and enclose a foot of a user. When fully assembled, the upper 42 also includes an interior surface 74 and an exterior surface 76. The interior surface 74 faces inward and generally defines the interior cavity 50, and the exterior surface 76 of the upper 42 faces outward and generally defines an outer perimeter or boundary of the upper 42. The interior surface 74 and the exterior surface 76 may comprise portions of the upper layers disclosed above. The upper 42 also includes an opening 78 that is at least partially located in the heel region 56 of the article of footwear 40, that provides access to the interior cavity 50 and through which a foot may be inserted and removed. In some embodiments, the upper 42 may also include an instep area 80 that extends from the opening 78 in the heel region 56 over an area corresponding to an instep of a foot to an area adjacent the forefoot region 52.

Referring to the left shoe 40 of FIG. 1, the sole structure 44 is shown in detail. The sole structure 44 of the present embodiment is formed to provide an enhanced or a different athletic benefit such as, e.g., trampoline effect, dampening, or pronation support. The sole structure 44 includes the void structure 46, which comprises the plurality of channels or voids 48 that are provided in alternating configurations. Each of the voids 48 extends through an entire width of the sole structure 44. The voids 48 extend through a midsole 84 of the sole structure, while an outsole 86 is shown extending from a bottom surface 88 of the midsole 84. An insole (not shown) is included, and may be connected to an interior surface of the articles of footwear 40. The insole may be positioned to be in direct contact with a user's foot while the shoe is being worn. A plurality of notches 90 are defined within the midsole 84, and the outsole 86 extends across the notches 90 defined within the forefoot region 52.

Still referring to FIG. 1, the outsole 86 does not extend across some of the notches 90 that are disposed within the midfoot region 54, i.e., the outsole 86 does not extend across five of the notches 90. In some embodiments, the outsole 86 may not extend across more or fewer of the notches 90. While the present embodiment includes eleven of the notches 90 along the sole structure 44, more or fewer of the notches 90 may be included. For example, there may be between four notches 90 and eighteen notches 90, or between six notches 90 and sixteen notches 90, or between eight notches 90 and fourteen notches 90. The heel region 56 includes a generally flat portion 92, which does not include any of the notches 90. The various notches 90 are positioned in combination with the voids 48 to provide enhanced and pre-determined cushioning features to the shoes 40.

In some instances, the outsole 86 may be defined as a portion of the sole structure 44 that at least partially contacts an exterior surface, e.g., the ground, when the articles of footwear 40 are worn. The insole (not shown) may be defined as a portion of the sole structure that at least partially contacts a user's foot when the article of footwear is worn. Finally, the midsole 84 may be defined as at least a portion of the sole structure 44 that extends between and connects the outsole region with the insole region. The midsole 84 may comprise a variety of materials, such as EVA Foam, e.g., PUMA Profoam Lite™. In some embodiments, polyurethane may be used within the midsole 84. In some embodiments, the midsole 84 or portions of the midsole 84 may comprise beads or pellets comprising particle foams such as eTPU or eTPE-E. Further, a dual- or multi-density midsole 84 may be used in some embodiments. In some embodiments, the midsole 84 comprises a gel. Further, in some embodiments, the midsole 84 comprises rubber. Still further, in some embodiments, the midsole 84 comprises a supercritical foam.

The void structure 46, in combination with the various notches 90 defined within and by the outsole 86, provide mechanical cushioning to the sole structure 44. As will be discussed in greater detail hereinafter below, the voids 48 of the void structure 46 are positioned such that the voids 48 allow the sole structure 44 to behave as an auxetic material, i.e., a structure having auxetic properties. Auxetic structures have high energy absorption when compressed and expand for more flexibility, and generally comprise structures or materials that have a negative Poisson's ratio. Generally, when an auxetic material is stretched, the material becomes thicker in a direction that is perpendicular to the applied force. As a result, under a tensile load, a material that exhibits auxetic properties will expand in a direction that is transverse to the direction of the load. The same principle applies when a compressive force is applied to an auxetic material, which in the present disclosure occurs when a wearer of the shoes 40 applies a downward force by taking a step to impact the ground.

When a compressive force is applied to an auxetic material, the material will contract, and is drawn inward in a direction that is transverse to the load. The deformation of auxetic structures occurs due to the particular internal structure of various voids and/or flexure arrangements. In the embodiment of FIG. 1, at least some of the voids 48 behave with auxetic characteristics, and are distributed in such an arrangement that the sole structure 44 programmably deforms when a downward, axial force is applied to the sole structure 44. The specific placement and arrangement of the various voids 48 depends on a desired amount of compression within a particular region of the sole structure 44, and the deformation of at least some of the voids 48 causes material that forms the sole structure 44 to be drawn inward, toward a center of the sole structure 44. With respect to the sole structures 44 discussed herein, implementing an auxetic void structure 46 results in less material being required to achieve a desired compression of the sole structure 44, which reduces an overall weight of the shoe. Reducing a weight of the sole structure 44 is a desirable outcome for wearers of shoes that engage in a number of activities, such as running, football, basketball, etc.

While the left and right shoes 40 shown in FIG. 1 include a sole structure 44 having superior cushioning properties due to the particular configuration of the void structure 46 therein, the present disclosure is directed to a variety of alternative void structures 46 having varying void patterns that could be implemented within the sole structure 44. As will be discussed in greater detail hereinafter below, the particular configuration of the voids 48 shown in FIG. 1 has been developed based on data collection and analysis related to pressure points and forces applied to the sole structure 44 to develop a structure for progressive cushioning. The sole structure 44 of the shoes 40 implements voids that define negative space resembling a lemniscate, i.e., an infinity sign or the outer profile of a "FIG. 8", and a structure that comprises foam, such as the materials discussed above.

Referring now to FIGS. 2A-2D, a material 98 is shown that has properties similar to properties of the sole structure 44 of FIG. 1. The material 98 is depicted transitioning from an uncompressed state in FIG. 2A to a compressed state in FIG. 2D. While the embodiments presented herein include void structures shown with a generic material, i.e., the material 98, it should be appreciated that the material is provided for illustrative purposes only. It is contemplated that void characteristics of the voids, such as the shapes, arrangements, orientations, and sizes of the voids may be different among the various void structures 46. Still further, the void structures 46 shown within the materials 98 may be utilized within any of the sole structures disclosed herein. Further, as noted herein, the term "void" or "voids" generically applies to one or more of the voids of a highlighted void structure, and the term "shape" refers to the shape of the outer profile of a void.

Figure 2A:
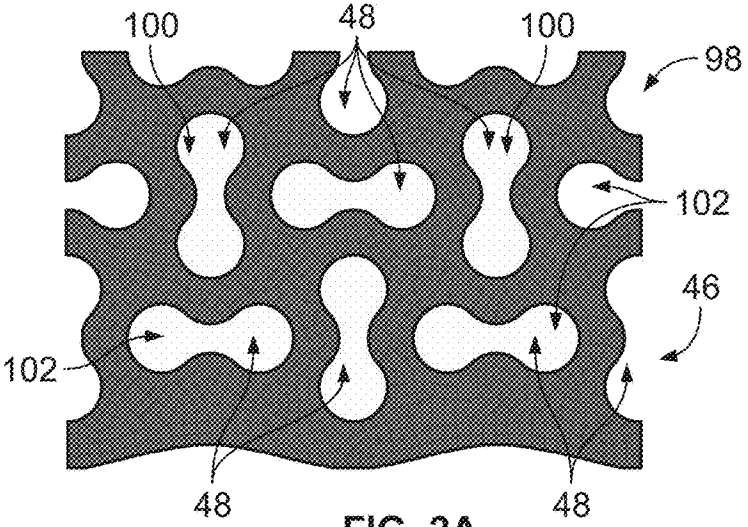
FIGS. 2A-2D illustrate portions of a material having a void structure similar to portions of the void structure of FIG. 1 transitioning from an uncompressed state in FIG. 2A to a compressed state in FIG. 2D.
Figure 2B:
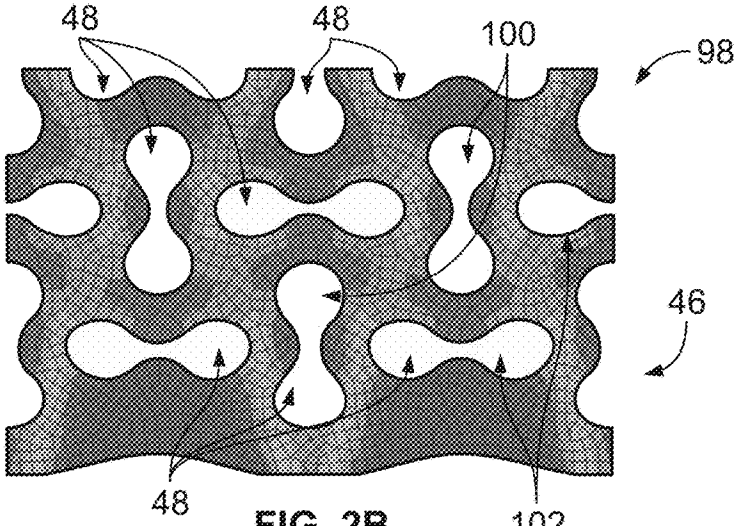
Figure 2C:
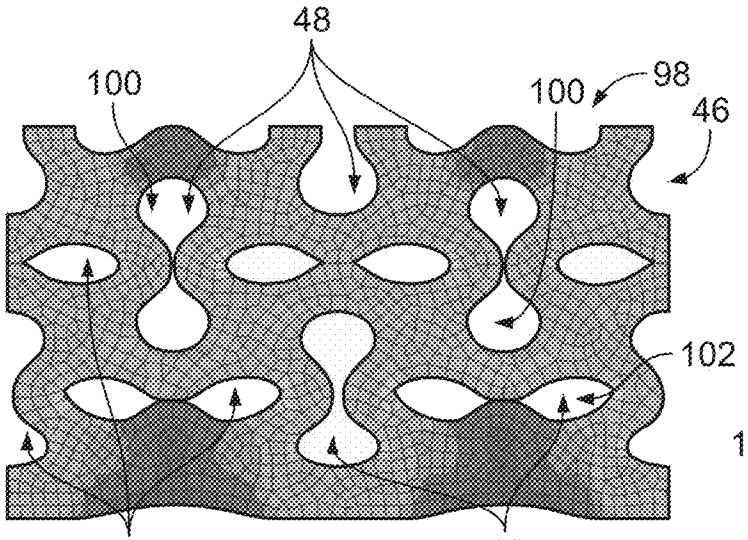
Figure 2D:
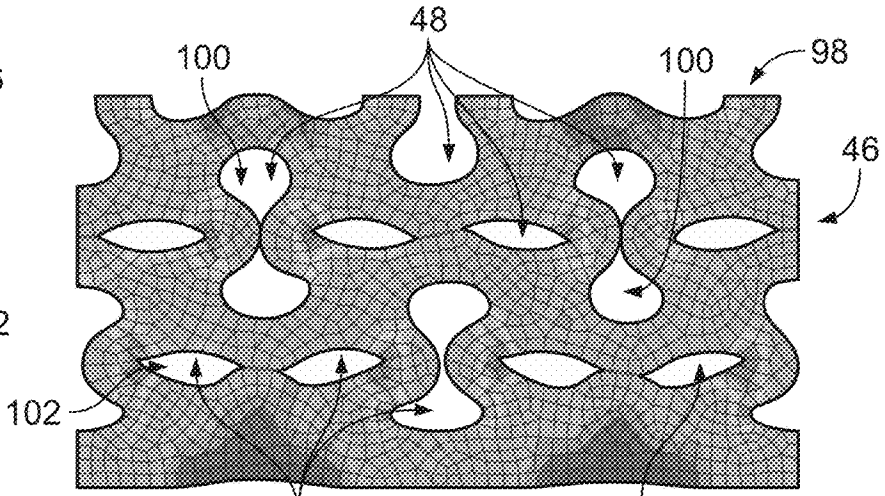

The voids 48 of FIGS. 2A-2D are provided in the form of alternating vertical and horizontal lemniscate shaped voids within the material 98, which transitions from an uncompressed state to a compressed state. To that end, the material 98 comprises first or vertical voids 100 and second or horizontal voids 102, the first voids 100 and the second voids 102 each comprising lobes at distal ends thereof, and waisted portions intermediate the distal lobes. The vertical voids 100 and the horizontal voids 102 generally define a grid that comprises rows and columns of various voids. In the particular embodiment of FIGS. 2A-2D, each row alternates between horizontal voids 102 and vertical voids 100, and each column further alternates between horizontal voids 102 and vertical voids 100. Referring now to the particular transition between compressive states, the transition between FIGS. 2A and 2D illustrates a representation of higher areas of stress that occur at various locations of the material when the material 98 is compressed. For example, as shown in FIGS. 2C and 2D, distal ends of the horizontal voids 102 achieve more significant stress than other areas of the material 98.

The transition between FIGS. 2A and 2D illustrates the deformation of the material 98 surrounding the voids 48, and various portions of the material 98 that result in increased stress, i.e., the ends of the horizontal voids 102. As illustrated in FIG. 2D, in the fully compressed state, opposing ends of the horizontal voids 102 achieve increased stress, and deformation and slippage of the horizontal voids 102 and the vertical voids 100 is increased. To that end, when a load is applied, the pattern shown in FIGS. 2A-2D results in more deformation than the pattern of the voids 48 shown in FIG. 1, which includes third or circular voids 104. The deformation of the material 98 that is achieved as shown in FIGS. 2A-2D can be beneficial for areas of the sole structure 44 that may be intended to achieve greater deformation, as discussed below. In certain areas of the sole structure 44, such deformation is desired, while other areas of the sole structure 44 may include fewer or alternative types of voids 48 to provide for an enhanced or optimal cushioning effect. Regardless, the positioning of the voids 48 within the sole structure 44 is based upon a targeted, programmable cushioning level for the particular sole structure 44.

Figure 3B:
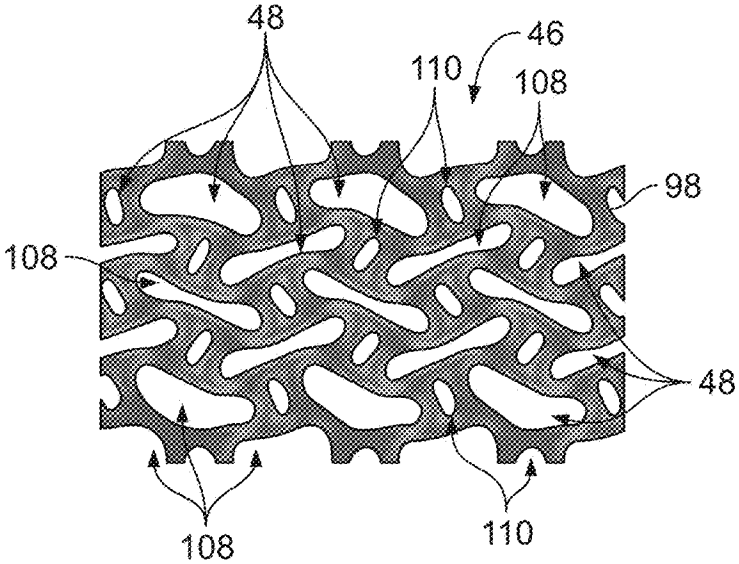
FIGS. 3A and 3B illustrate another material having a void structure, the material shown in an uncompressed state and a compressed state, respectively.
Figure 3A:
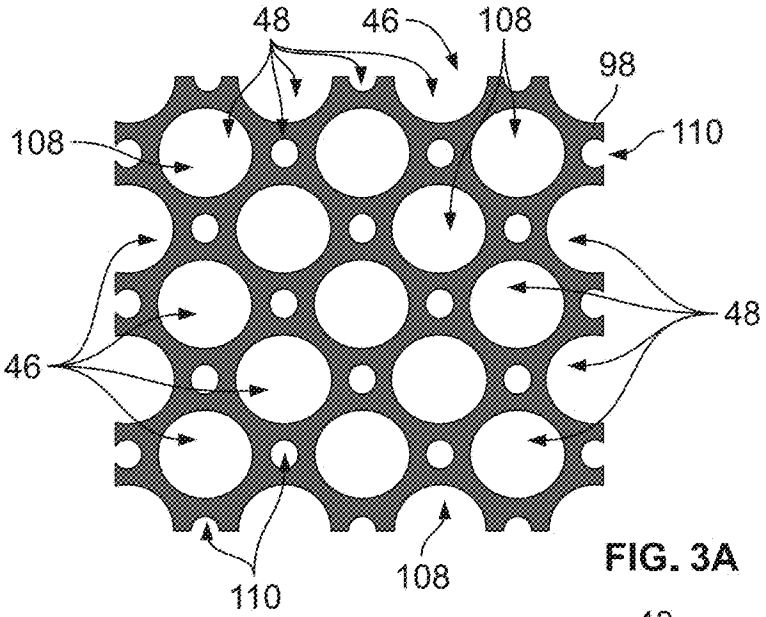

FIGS. 3A and 3B illustrate another material 98 that has properties that are similar to the sole structure 44, the material 98 having another embodiment of the void structure 46 provided therein. The void structure 46 comprises alternating circular voids of varying sizes. More specifically, the void structure 46 comprises large circular voids 108 and small circular voids 110, which alternate in both a vertical and a horizontal direction. The void structure 46 shown in FIGS. 3A and 3B illustrates an exemplary embodiment of an auxetic pattern that comprises voids having shapes of differing sizes. Referring to FIG. 3A, the material 98 is shown in an uncompressed state, and the material 98 is shown in FIG. 3B in a compressed state. Referring specifically to FIG. 3B, during compression of the material 98, the large circular voids 108 are shown to deform or compress in alternating directions, which allows for substantial compression of the material 98. Because the large circular voids 108 comprise relatively more volume than portions of the material 98 that are disposed between the various voids 108, 110, the material 98 achieves significantly more compression when a force is applied, compared against a similar material that comprises more of the material 98 disposed between the various voids 108, 110. Certain properties of the void structure 46 shown within the material 98 may be implemented within one or more of the sole structures 44 discussed herein.

Figure 4:
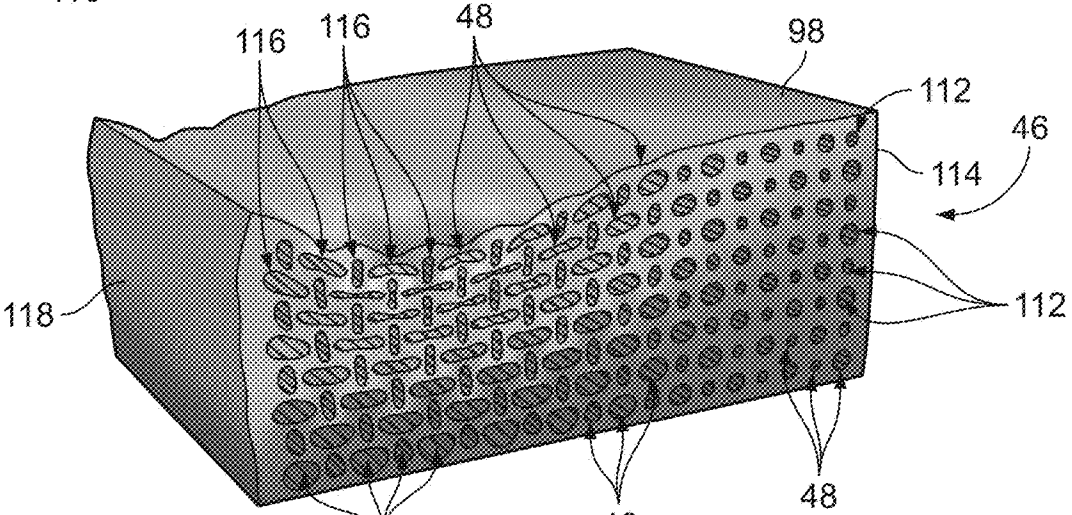
FIG. 4 is an isometric view of another material having a void structure with voids of varying shapes and sizes, the material shown having a force applied to a portion thereof.

FIG. 4 is an isometric view of yet another material 98 that has properties that are similar to the sole structure 44, the material 98 having another void structure 46 comprising both alternating shapes and alternating sizes of voids therein. The void structure 46 of FIG. 4 includes circular voids 112 along a right side 114 thereof, and elongate voids 116 along a left side 118 thereof. A compressive force is applied to the left side 118 of the material 98 which highlights the deformation of the elongate voids 116 along the left side 118 of the material 98. The material 98 is highlighted to illustrate that the various materials discussed herein may include void structures 46 that include voids 48 having alternating shapes and sizes, which may vary along a length of the material 98. As noted with respect to FIGS. 3A and 3B, certain properties of the void structure 46 shown within the material 98 may be implemented within one or more of the sole structures 44 discussed herein. The embodiments of FIGS. 3A-4 are provided to illustrate how the various void patterns described herein may be implemented within a material, which may comprise the sole structure 44 disclosed herein.

FIGS. 5A-5H illustrate alternative void structures 46 in varying configurations, which are provided within another material 98 that has properties that are similar to the sole structure 44. The various void structures shown in FIGS. 5A-5H define patterns that could be implemented within the sole structure 44 disclosed herein, and may be provided with alternating shapes, or varying sizes along the sole structure 44. The void structures 46 of FIGS. 5A-5H have been found to fit within the constraints of various injection molded manufacturing processes, and have desirable compression and deformation properties. While the patterns of void structures 46 within each of FIGS. 5A-5H are shown having material of a particular thickness between each of the voids 48, it is contemplated that additional material may be provided between the various voids 48 that comprise the void structures 46 shown therein, and that the voids 48 may comprise alternating sizes. Still further, any of the void structures 46 shown in FIGS. 5A-5H may be combined within a midsole 84 with a different type of void structure 46, and need not be limited to the particular arrangement or orientation as shown in the figures. As noted above, the void structures 46 of FIGS. 5A-5H include voids that extend entirely through the material 98 to define channels.

Figure 5A:
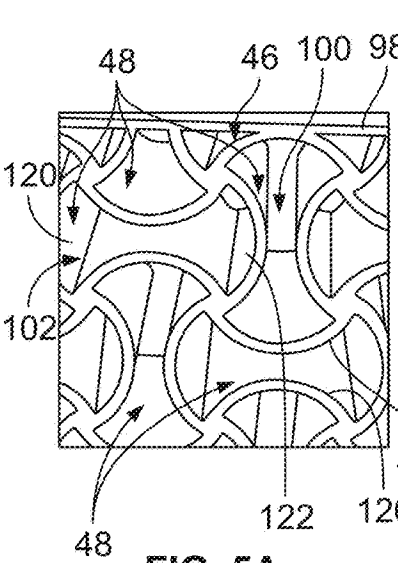
FIGS. 5A-5H illustrate alternative void structures that are shown in an uncompressed state.

Referring to FIG. 5A, the void structure 46 shown therein defines a quadratic structure, i.e., each of the voids 48 is defined by four sides. The void structure 46 includes alternating horizontal voids 102 and vertical voids 100, which are separated by portions of the material 98. To that end, the void structure 46 of FIG. 5A only includes two types of voids, i.e., horizontal voids 102 and vertical voids 100. The voids 48 include lobes at opposing ends thereof, and a waisted midsection between the lobed ends. The horizontal voids 102 of the void structure 46 include opposing left and right ends 120, 122 that generally define a convex profile, bowing away from the midsection. The horizontal voids 102 further define top and bottom ends 124, 126 that are generally concave and bow inward with respect to the midsection thereof. As a result, the left and right ends 120, 122 of the voids 48 intersect with the top and bottom ends 124, 126 thereof. The vertical voids 100 are identical in profile to the horizontal voids 102, but are offset by 90 degrees from the horizontal voids 102. As noted above, portions of the material 98 may be thickened to adjust the compressibility of the structure shown in FIG. 5A.

Figure 5B:
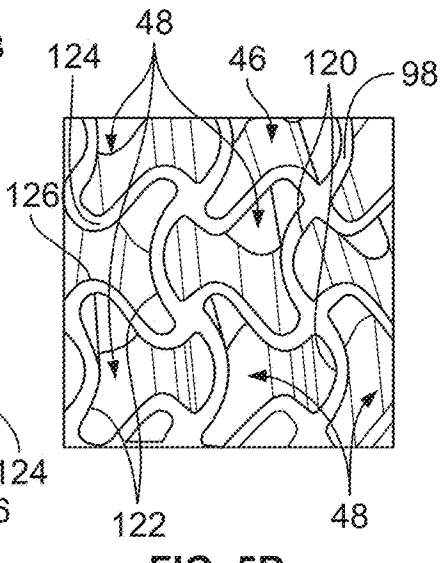

Referring to FIG. 5B, the void structure 46 shown therein includes a quadratic structure where each of the voids 48 is oriented in the same direction within each row, i.e., the voids 48 are not alternating within each row. However, the voids 48 alternate within each of the columns. The left and right ends 120, 122 of the voids 48 each define concave profiles with respect to a central portion of each of the voids 48, while the top and bottom ends 124, 126 are generally wavy or undulating, and define a sinusoidal pattern. The voids 48 of FIG. 5B also define lobes at opposing ends of each of the voids 48, however, one of the lobes is larger than the other of the lobes. As a result, the voids 48 of FIG. 5B are only symmetric about a single axis that extends horizontally through each of the voids 48.

Figure 5C:
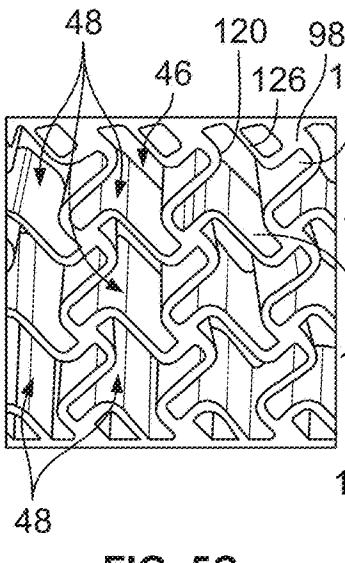

Referring to FIG. 5C, the void structure 46 shown therein includes a quadratic pattern where each of the voids 48 is oriented in the same direction with respect to both rows and columns. All of the ends 120, 122, 124, 126 of each of the voids 48 are identical with respect to one another, such that the voids 48 are symmetric about orthogonal axes that intersect through a center of the voids 48. Each of the ends 120, 122, 124, 126 defines an "S" shape, i.e., edges defining each of the ends 120, 122, 124, 126 of the voids 46 includes a generally straight portion and two curved portions that curve from the straight portion in opposite directions. Each of the voids 48 may be characterized as having four lobes that extend from the central portion.

Figure 5D:
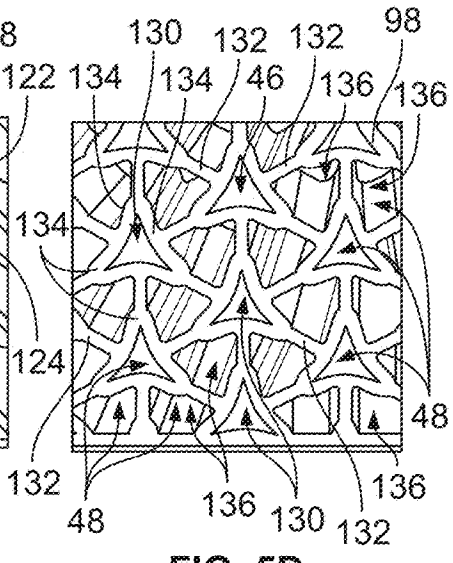

Referring to FIG. 5D, the void structure 46 shown therein is generally hexagonal in nature and is characterized by low density and offset collapse functionality. The void structure 46 includes at least seven different shapes of voids 48, wherein a central void 130 is triangular in shape, and six peripheral arms 132 of the material 98 extend outwardly from triangular legs 134 that define the central void 130. The peripheral arms 132 and the legs 134 further define peripheral voids 136 that are disposed about the central void 130. Each of the arms 132 intersect with at least one of the legs 134 defining another one of the peripheral voids 136. With respect to this particular configuration of voids, compression was found to occur by accordion folding of the legs 134 at the various points of connection of the material 98, concentrating stress in a few small areas.

Figure 5E:
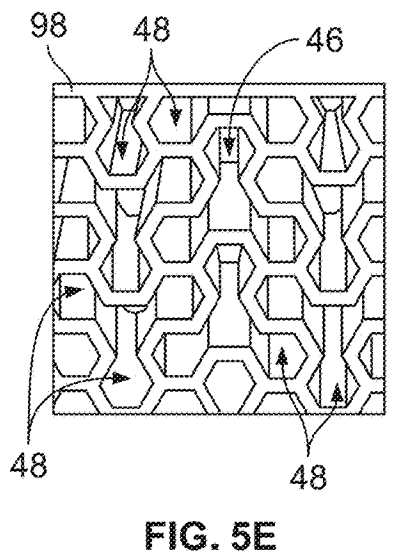

Referring to FIG. 5E, the void structure 46 shown therein is also hexagonal in nature, and is formed from multiple cellular shapes. To that end, the voids 48 are each defined by hexagons and triangles instead of a single tessellated form. The voids 48 of the void structure 46 of FIG. 5E each include a central region that is generally triangular in nature, and three lobes defined by generally hexagonal profiles. The voids 48 are generally aligned and disposed in the same direction within each column, but the voids 48 alternate in direction within each of the rows. The configuration of the voids 48 as depicted in FIG. 5E can result in an asymmetric chirality, which can result in increased horizontal shearing when compressed, which may be beneficial within certain portions of a sole structure.

Figure 5F:
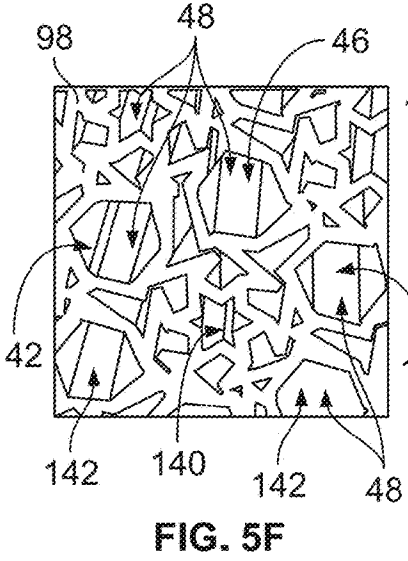

Referring to FIG. 5F, the void structure 46 shown therein includes a central star-shaped void 140, which is further surrounded by a plurality of peripheral voids 142. The peripheral voids 142 that surround the central star-shaped void 140 define a generally asymmetric pattern. While the void structure 46 shown in FIG. 5F includes some symmetry, the void structure shown therein is generally asymmetric, and includes voids of varying sizes, shapes, and orientations. However, the various voids 48 are generally defined by portions of the material 98 that extend outward from the central star-shaped void 140 to achieve the void structure 46.

Figure 5G:
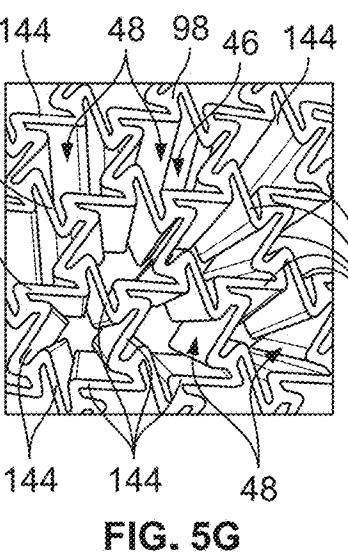

Referring to FIG. 5G, the void structure 46 shown therein is also hexagonal in nature, and is disposed in the same orientation across the rows and columns that define the void structure 46. Each of the voids 48 of the void structure 46 is symmetric about three axes that intersect one another within a center point of each of the voids 48, the axes being offset by 120 degrees. Each of the voids 48 is defined by sixteen legs 144, with the legs 144 defining varying acute angles to define each of the voids 48. Under compression, the pairs of legs, in combination, behave as a spring.

Figure 5H:
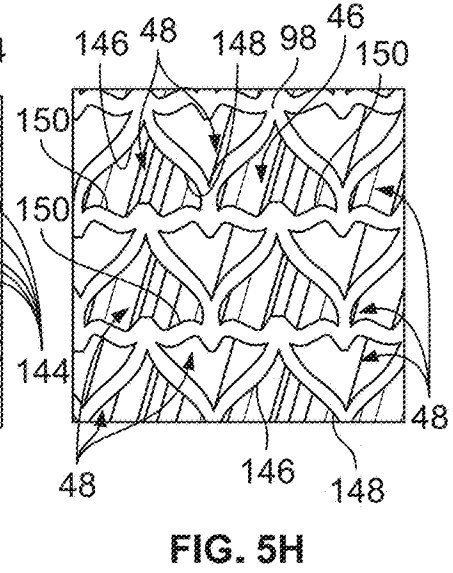

Referring to FIG. 5H, the void structure 46 shown therein includes first voids 100 and second voids 102, which alternate moving from left to right across the rows, but are oriented or aligned in the same direction within each of the columns. The first voids 100 each comprise a larger volume than each of the second voids 102. The first voids 100 define profiles having left sides 146 and right sides 148 that are joined together at intersections. A bottom side 150 of the first voids 100 is wavy, and is centrally intersected by a portion of the material 98 that defines one of the first voids 100 immediately below. The first voids 100 and the second voids 102 alternate along rows, but are aligned within columns. The first voids 100 and the second voids 102 are also each only symmetric about a single axis that centrally bisects each of the voids 48.

FIGS. 6A-6G illustrate isometric views of alternative void structures shown in an uncompressed state. The various void structures shown in FIGS. 6A-6G define patterns that could be implemented within the sole structure 44 disclosed herein, and may be provided with alternating shapes, different orientations, or varying sizes along the sole structure 44. The void structures 46 of FIGS. 6A-6G have been found to achieve various benefits, and define varying levels of compression and shear. As discussed herein, the term "shear" refers to deformation of the material in a horizontal direction, perpendicular to the direction of the applied force. Some of the materials discussed herein are shearing auxetic materials, which expand with a bias rather than isotopically expanding. While the patterns of void structures 46 within each of FIGS. 6A-6G are shown having material of a particular thickness between each of the voids 48, it is contemplated that additional material may be provided between the various voids 48 that comprise the void structures 46 shown therein, and that the voids 48 may comprise alternating sizes. Still further, any of the void structures 46 shown in FIGS. 6A-6G may be combined within a sole structure 44 having a different type of void structure 46. The void structures 46 of FIGS. 6A-6G extend entirely through the material 98, to define channels.

Figure 6A:
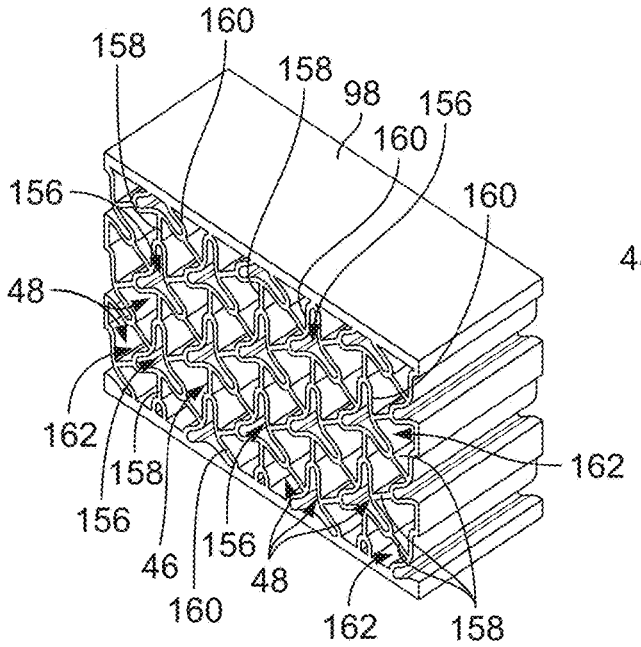
FIGS. 6A-6G illustrate isometric views of alternative void structures that are shown in an uncompressed state.
Figure 7B:
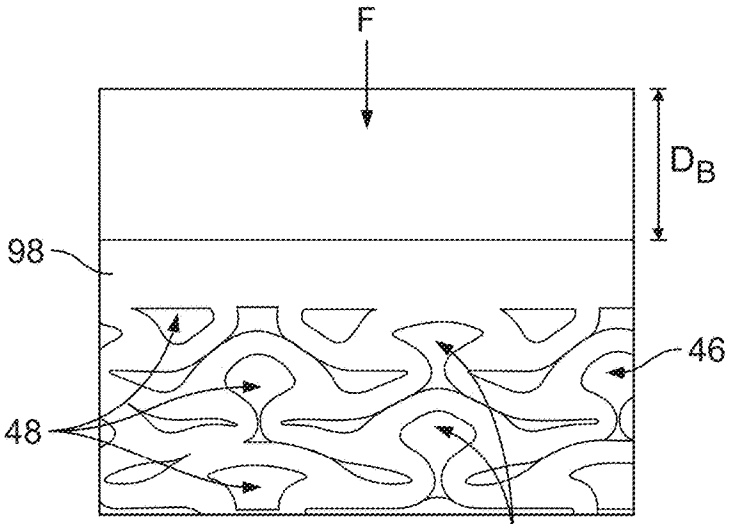
FIGS. 7A-7G illustrate side views of the void structures of FIGS. 6A-6G, respectively, that are shown in a compressed state.
Figure 7A:
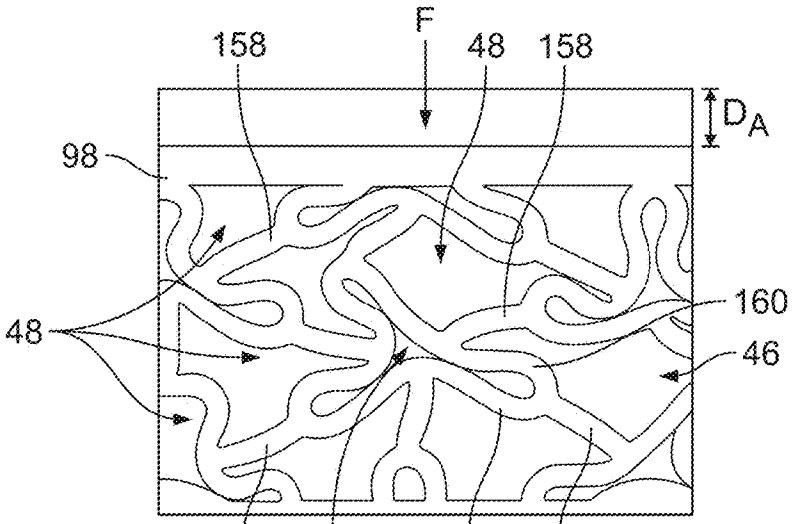

Referring to FIGS. 6A and 7A, another void structure 46 is shown within a material 98 in an uncompressed and a compressed state, respectively. The void structure 46 of FIG. 6A is similar but not identical in form to the void structure of FIG. 5D, and includes at least seven different shapes of voids 48, wherein a central void 156 includes three lobes that are offset by 120 degrees each. Six peripheral arms 158 of the material 98 extend outwardly from beams 160 that define the central void 156. The peripheral arms 158 and the beams 160 further define peripheral voids 162 that are disposed about the central void 156. Each of the arms 158 intersect with one of the beams 160 defining another one of the peripheral voids 162. With respect to this particular configuration of voids, compression was found to occur by accordion folding, concentrating stress in a few small areas, the compression of the material being shown in FIG. 7A. To that end, as compression occurs, the central void 156 collapses, and the various arms 158 slightly deform, but generally maintain their form. The central void 156 deforms in such a way that four separate cavities or channels are defined by the beams 160 defining the central void 156. As shown in FIG. 7A, under a load X, the material 98 compresses by a di stance $D_A$.

Figure 6B:
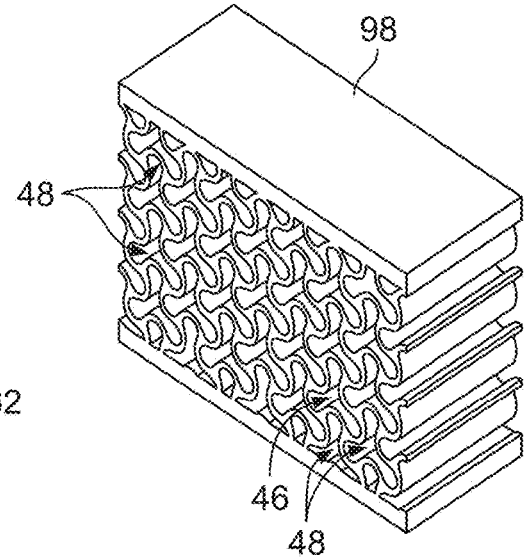

Referring to FIGS. 6B and 7B, another void structure 46 is shown within the material 98 in an uncompressed and a compressed state, respectively. The void structure 46 of FIG. 6B includes a repeating pattern of multi-lobed voids 48. The multi-lobed voids 48 each include three lobes that are spaced from one another by 120 degrees. The voids 48 of FIG. 6B are therefore symmetric about three axes, i.e., axes that are separated 120 degrees apart from one another. During compression, the voids 48 generally compress straight downward, and cause significant compression of the material 98 when a load X is applied. As shown in FIG. 7B, under a load X, the material 98 compresses by a distance $D_B$. The distance $D_B$ is larger than the distance $D_A$ discussed above with respect to FIG. 7A.

Figure 6C:
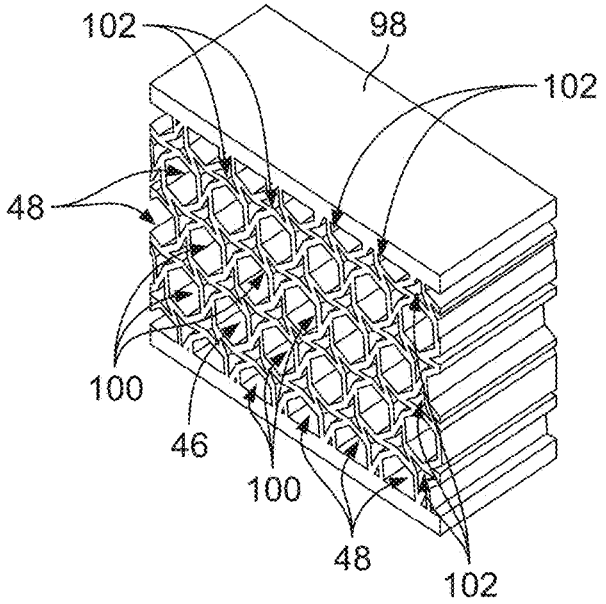
Figure 7D:
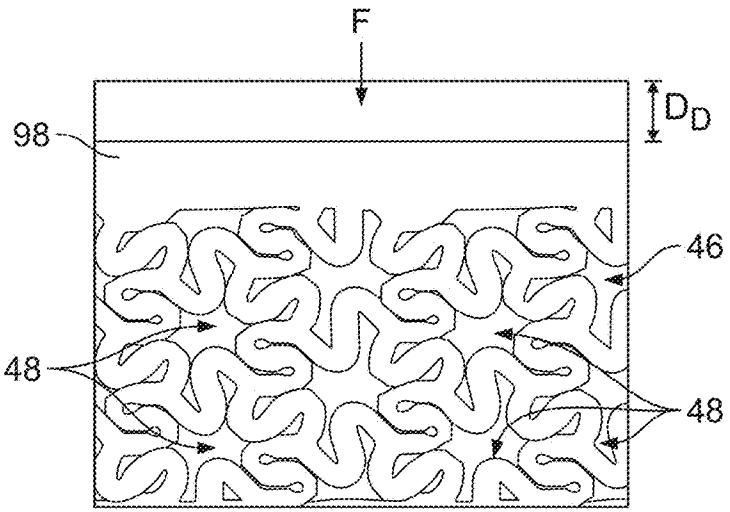
Figure 7C:
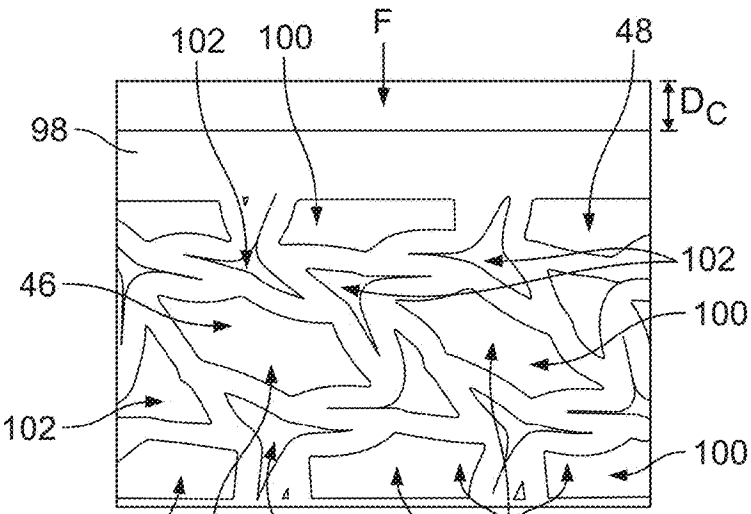

Referring to FIGS. 6C and 7C, another void structure 46 is shown within the material 98 in an uncompressed and a compressed state, respectively. The void structure 46 includes first voids 100 that define hexagonal shapes and second voids 102 that define concave hexagonal shapes, the first voids 100 being larger than the second voids 102. The second voids 102 define six sides, and surround the first voids 100. The first voids 100 are completely separated from one another by the second voids 102. To that end, six of the second voids 102 are spaced about each of the first voids 100. When a compressive force is applied, the void structure 46 deforms in such a way that the material 98 shears, i.e., the material 98 translates in the horizontal direction. To that end, the sides of the first voids 100 partially rotate about a central point of the first voids 100 due to the compressive force applied. As shown in FIG. 7C, under a load X, the material 98 compresses by a distance $D_C$. However, the distance $D_C$ is smaller than the distances $D_A$, $D_B$ discussed above.

Figure 6D:
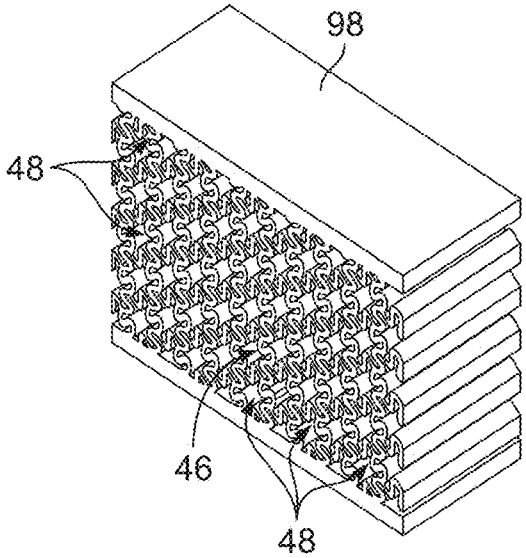

Referring to FIGS. 6D and 7D, another void structure 46 is shown within the material 98 in an uncompressed and a compressed state, respectively. The void structure 46 includes a repeating pattern of voids 48 that are identical in shape, and each define a central portion from which six lobes of the void 48 extend. Each of the voids 48 includes at least eighteen inflection points, i.e., points at which the voids 48 may pivot when deformation occurs as a compressive load is applied. The voids 48 are symmetric about at least three axes, which are separated from one another by 120 degrees and extend centrally through one of the voids 48. As shown in FIG. 7D, under a load X, the material 98 compresses by a distance $D_D$. The distance $D_D$ is similar to the distance $D_C$ discussed above.

Figure 6E:
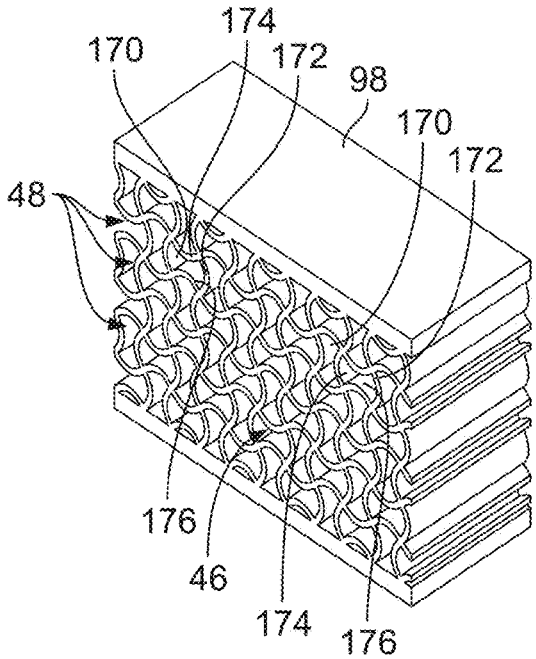
Figure 7E:
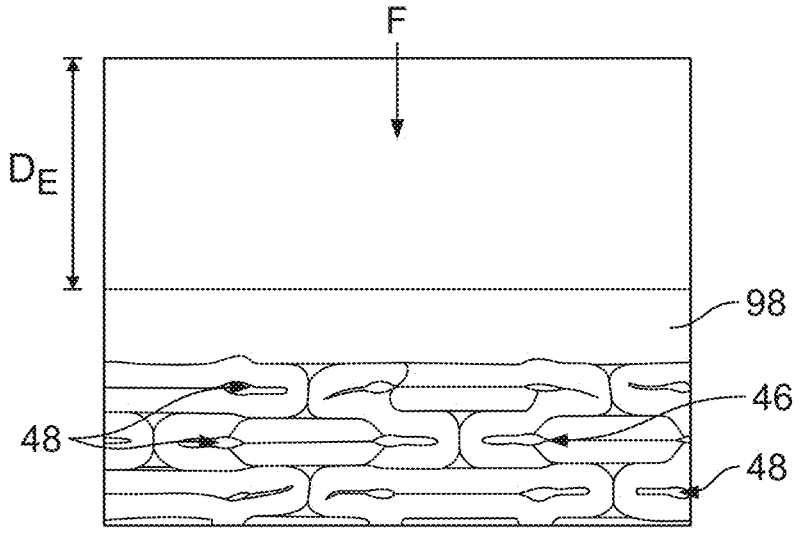

Referring to FIGS. 6E and 7E, another void structure 46 is shown within the material 98 in an uncompressed and a compressed state, respectively. The void structure 46 of FIGS. 6E and 7E is similar to the void structure discussed above with respect to FIG. 5A, and includes a quadratic structure. The void structure 46 includes alternating horizontal voids 102 and first voids 100, which are separated by portions of the material 98. To that end, the void structure 46 only includes two types of voids, i.e., horizontal voids 102 and first voids 100. The voids 48 include lobes at opposing ends thereof, and a waisted midsection between the lobed ends. The horizontal voids 102 of the void structure 46 include opposing left and right ends 170, 172 that generally define a convex profile, bowing away from the midsection. The horizontal voids 102 further define top and bottom ends 174, 176 that are generally concave and bow inward with respect to the midsection thereof. As a result, the left and right sides 170, 172 intersect with the top and bottom sides 174, 176. The first voids 100 are identical in profile to the horizontal voids 102, but are offset by 90 degrees from the horizontal voids 102. As shown in FIG. 7E, under a load X, the material 98 compresses by a distance $D_E$. The distance $D_E$ is greater than all of the distances discussed above, i.e., $D_A$, $D_B$, $D_C$, and $D_D$.

Figure 6F:
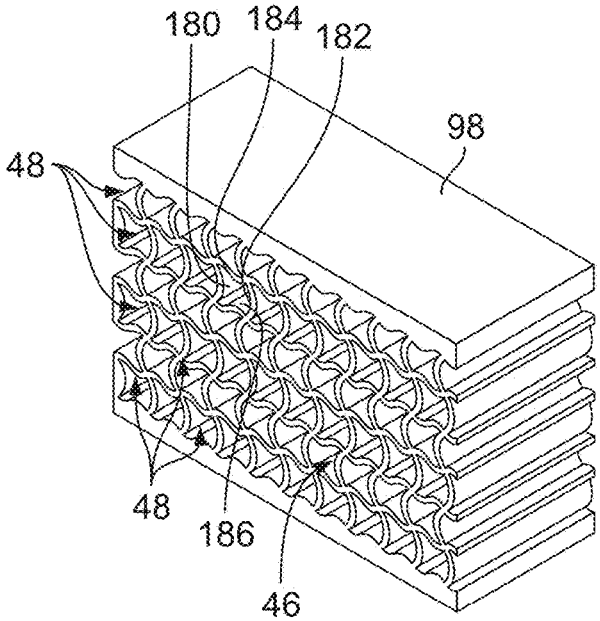
Figure 7F:
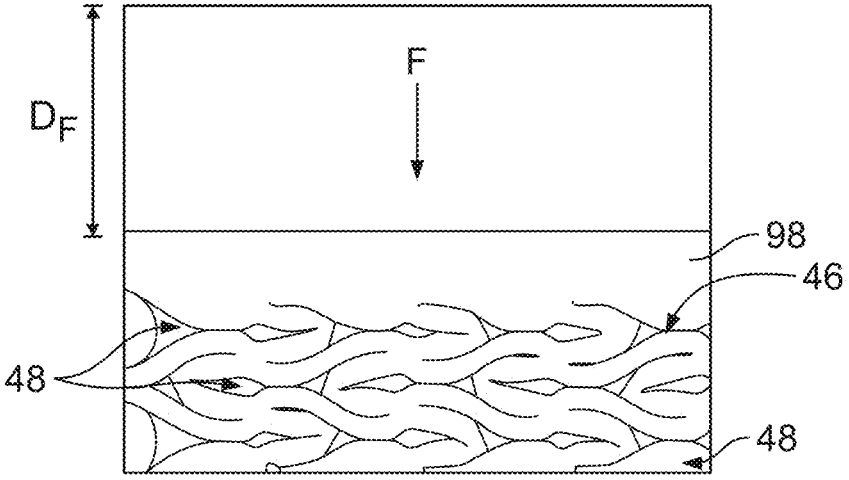

Referring to FIGS. 6F and 7F, another void structure 46 is shown within the material 98 in an uncompressed and a compressed state, respectively. The void structure 46 of FIGS. 6F and 7F is similar to the void structure of FIG. 5B, i.e., the void structure 46 is a quadratic structure where each of the voids 48 is oriented in the same direction within each row, i.e., the voids 48 are not alternating within each row. However, the voids 48 alternate within each of the columns. Left and right ends 180, 182 of the voids 48 each define concave profiles with respect to a central portion of each of the voids 48, while the top and bottom ends 184, 186 are generally wavy or undulating, and define a sinusoidal pattern. The voids 48 of FIGS. 6F and 7F define lobes at opposing ends of each of the voids 48, however, one of the lobes is larger than the other of the lobes. As a result, the voids 48 are only symmetric about a single axis that extends horizontally through each of the voids 48. As shown in FIG. 7F, under a load X, the material 98 compresses by a distance $D_F$. The distance $D_F$ is similar to the distance $D_E$ discussed above.

Figure 6G:
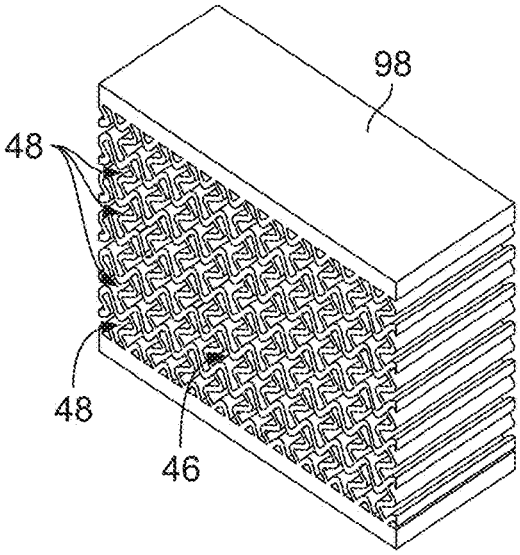
Figure 7G:
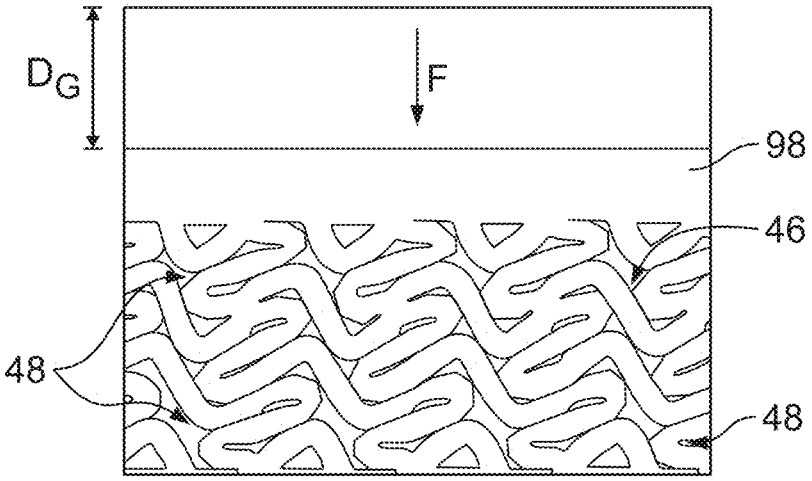

Referring to FIGS. 6G and 7G, another void structure 46 is shown within the material 98 in an uncompressed and a compressed state, respectively. The void structure 46 of FIGS. 6G and 7G is quadratic, and is symmetric about orthogonal axes that intersect one another at a central point within one of the voids 48. The voids 48 are all identical, and are oriented in the same direction within the various rows and columns. As shown in FIG. 7G, the void structure 46 causes the material 98 to slightly shear during compression. As shown in FIG. 7G, when subjected to a load X, the material 98 compresses by a distance $D_G$. The distance $D_G$ is greater than the distances $D_E$ and $D_F$ discussed above.

As discussed above, the various void structures 46 discussed herein that are configured to form auxetic materials are beneficial because when a compressive force is applied to the void structures 46, the material 98 surrounding the void structure 46 contracts, and is drawn inward in a direction that is transverse to the load. Thus, when a compressive force is applied, the void structure 46 causes the material 98 to contract, and provides additional material and support underneath the compressive load. Because the material 98 is caused to contract inward when a force is applied, less material is required to provide a similar amount of support as a material that does not include any type of void structure 46 therein.

Figure 8:
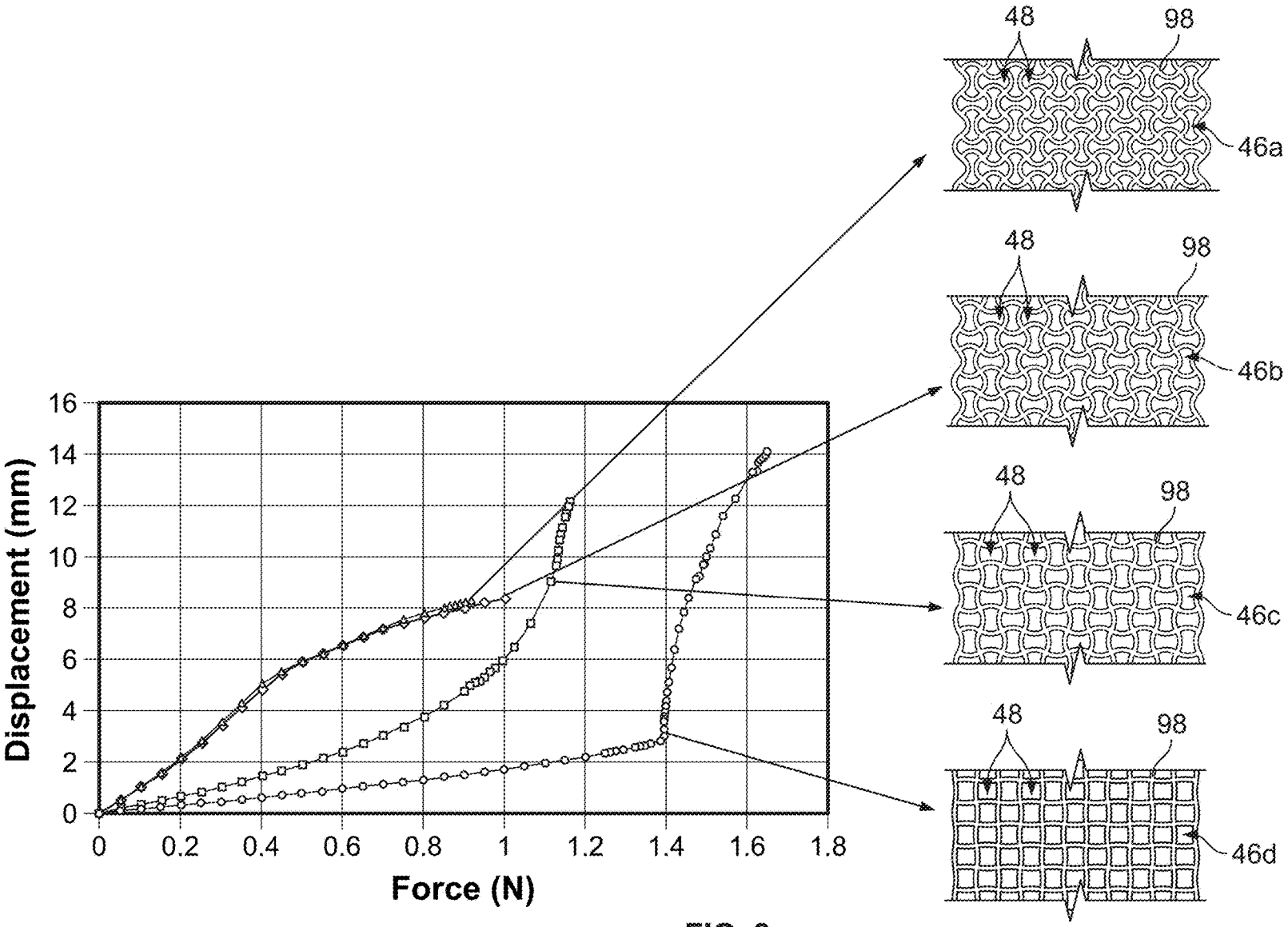
FIG. 8 is a graph comparing displacement of materials comprising various void structures against a force applied to the various void structures.

FIG. 8 is a graph comparing displacement of various auxetic structures against a force applied to the various auxetic structures. A linear compression was applied to materials comprising the void structures 46 shown adjacent the graph. The void structures 46*a*, 46, which are similar to the void structure 46 shown above in FIG. 6E, achieve a relatively constant displacement from 0.0 N (Newtons) to 0.40 N, and a relatively constant, linear displacement from 0.45 N to 0.90 N. In contrast, the void structure 46*c* achieves an exponential displacement, while the void structure 46*d* achieves a linear displacement between 0.0 N and 1.4 N, and a logarithmic displacement between 1.4 N and 1.65 N. The various displacement curves depicted in the graph of FIG. 8 highlight the different displacement characteristics that can be achieved by varying the geometry of the void structure 46, even among repeating quadratic structures. The graph further illustrates that patterns of void structures 46 that have elements of curvature and self-reinforcement can provide a transitionary increase in compression resistance. Still further, the data indicates how various portions of the sole structure 44, which are subject to different loading forces, can be manufactured to include varying void structures 46 to achieve programmable deformation.

As discussed above, FIG. 9 is a schematic view of the sole structure 44 having the skeletal structure of a foot overlaid to illustrate various portions of the sole structure 44. While the sole structure 44 of the left shoe is shown, it should be appreciated that the sole structure 44 of the right shoe 40 is a mirror image thereof. To that end, the articles of footwear 40 each define a forefoot region 52, a midfoot region 54, and a heel region 56. The forefoot region 52 generally corresponds with portions of the article of footwear 40 that encase portions of the foot that include the toes, the ball of the foot, and joints connecting the metatarsals with the toes or phalanges. The midfoot region 54 is proximate and adjoining the forefoot region 52, and generally corresponds with portions of the article of footwear 40 that encase the arch of a foot, along with the bridge of a foot. The heel region 56 is proximate and adjoining the midfoot region 54 and generally corresponds with portions of the article of footwear 40 that encase rear portions of the foot, including the heel or calcaneus bone, the ankle, or the Achilles tendon. While the present disclosure relates to a left and a right shoe that are substantially the same, in some embodiments there may be differences between a left shoe and a right shoe other than the left/right configuration. Further, in some embodiments, a left shoe may include one or more additional elements that a right shoe does not include, or vice versa.

Referring in particular to FIG. 9, the medial side 72 and the lateral side 70 adjoin one another along a longitudinal central plane or axis 190 of the article of footwear 40. As will be further discussed herein, the longitudinal central plane or axis 190 may demarcate a central, intermediate axis between the medial side 72 and the lateral side 70 of the article of footwear 40. Put differently, the longitudinal plane or axis 190 may extend between a heel end 192 of the article of footwear 40 and a toe end 194 of the article of footwear 40 and may continuously define a middle of an insole, the sole structure 44, or the upper 42 of the article of footwear 40, i.e., the longitudinal plane or axis 190 may be a straight axis extending through the heel end 192 of the heel region 56 to the toe end 194 of the forefoot region 52.

The forefoot region 52, the midfoot region 54, the heel region 56, the medial side 72, and the lateral side 70 are intended to define boundaries or areas of the article of footwear 40. To that end, the forefoot region 52, the midfoot region 54, the heel region 56, the medial side 72, and the lateral side 70 generally characterize sections of the article of footwear 40. Certain aspects of the disclosure may refer to portions or elements that are coextensive with one or more of the forefoot region 52, the midfoot region 54, the heel region 56, the medial side 72, or the lateral side 70. Further, both the upper 42 and the sole structure 44 may be characterized as having portions within the forefoot region 52, the midfoot region 54, the heel region 56, or along the medial side 72 or the lateral side 70. Therefore, the upper 42 and the sole structure 44, or individual portions of the upper 42 and the sole structure 44, may include portions thereof that are disposed within the forefoot region 52, the midfoot region 54, the heel region 56, or along the medial side 72 or the lateral side 70.

Still referring to FIG. 9, the forefoot region 52, the midfoot region 54, the heel region 56, the medial side 72, and the lateral side 70 are shown in detail. The forefoot region 52 extends from the toe end 194 to a widest portion 198 of the article of footwear 40. The widest portion 198 is defined or measured along a first line 200 that is perpendicular with respect to the longitudinal axis 190 that extends from a distal portion of the toe end 194 to a distal portion of a heel end 192, which is opposite the toe end 194. The midfoot region 54 extends from the widest portion 198 to a thinnest portion 202 of the article of footwear 40. The thinnest portion 202 of the article of footwear 40 is defined as the thinnest portion of the article of footwear 40 measured along a second line 204 that is perpendicular with respect to the longitudinal axis 190. The heel region 56 extends from the thinnest portion 202 to the heel end 192 of the article of footwear 40.

It should be understood that numerous modifications may be apparent to those skilled in the art in view of the foregoing description, and individual components thereof, may be incorporated into numerous articles of footwear. Accordingly, aspects of the article of footwear 40 and components thereof, may be described with reference to general areas or portions of the article of footwear 40, with an understanding that the boundaries of the forefoot region 52, the midfoot region 54, the heel region 56, the medial side 72, or the lateral side 70 as described herein may vary between articles of footwear. However, aspects of the article of footwear 40 and individual components thereof, may also be described with reference to exact areas or portions of the article of footwear 40 and the scope of the appended claims herein may incorporate the limitations associated with these boundaries of the forefoot region 52, the midfoot region 54, the heel region 56, the medial side 72, or the lateral side 70 discussed herein.

Still referring to FIG. 9, the medial side 72 begins at the distal toe end 194 and bows outward along the forefoot region 52 toward the midfoot region 54. At the first line 200, the medial side 72 bows inward, toward the central, longitudinal axis 190. The medial side 72 extends from the first line 200, i.e., the widest portion 198, toward the second line 204, i.e., the thinnest portion 202, entering into the midfoot region 54 upon crossing the first line 200. After reaching the second line 204, the medial side 72 bows outward, away from the longitudinal, central axis 190, at which point the medial side 72 extends into the heel region 56, i.e., upon crossing the second line 204. The medial side 72 then bows outward and then inward toward the heel end 192, and terminates at a point where the medial side 72 meets the longitudinal, center axis 190.

The lateral side 70 also begins at the distal toe end 194 and bows outward along the forefoot region 52 toward the midfoot region 54. The lateral side 70 reaches the first line 200, at which point the lateral side 70 bows inward, toward the longitudinal, central axis 190. The lateral side 70 extends from the first line 200, i.e., the widest portion 198, toward the second line 204, i.e., the thinnest portion 202, entering into the midfoot region 54 upon crossing the first line 200. After reaching the second line 204, the lateral side 70 bows outward, away from the longitudinal, central axis 190, at which point the lateral side 70 extends into the heel region 56, i.e., upon crossing the second line 204. The lateral side 70 then bows outward and then inward toward the heel end 192, and terminates at a point where the lateral side 70 meets the longitudinal, center axis 190.

Figure 10:
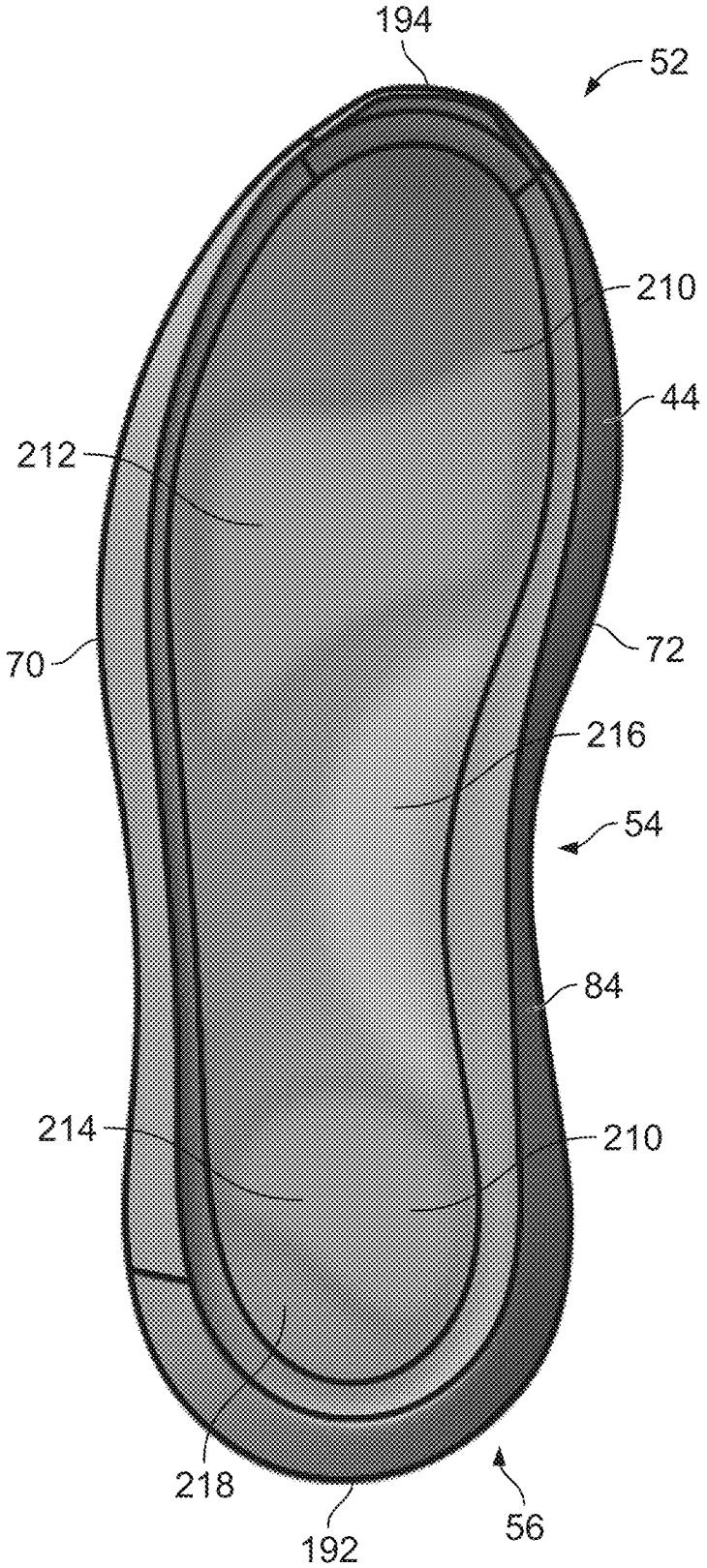
FIG. 10 a top view of a sole structure highlighting differing forces applied to different various zones of a sole structure.

FIG. 10 is a top, schematic view of the sole structure 44 highlighting differing zones within the sole structure 44 that are subject to differing loads when a user applies a force to the sole structure 44. A first zone 210 is shown, the first zone 210 including two separate portions, i.e., a first portion 212 and a second portion 214. The first portion 212 spans the forefoot region 52 and the midfoot region 54. The second portion 214 of the first zone 210 spans the heel region 56, and is disposed entirely within the heel region 56. The first portion 212 of the first zone 210 defines a curved trapezoidal shape, and the second portion 214 defines a semi-circular shape when viewed from above. A second zone 216 is also shown, which defines a crescent shape, and spans the midfoot region 54 and the heel region 56, along the medial side 72 of the sole structure 44. The second zone 216 generally follows or aligns with a profile of the sole structure 44 within the midfoot region 54 thereof. A third zone 218 is also shown, the third zone 218 being disposed entirely within the heel region 56, and adjacent the second portion 214 of the first zone 210.

Figure 11:
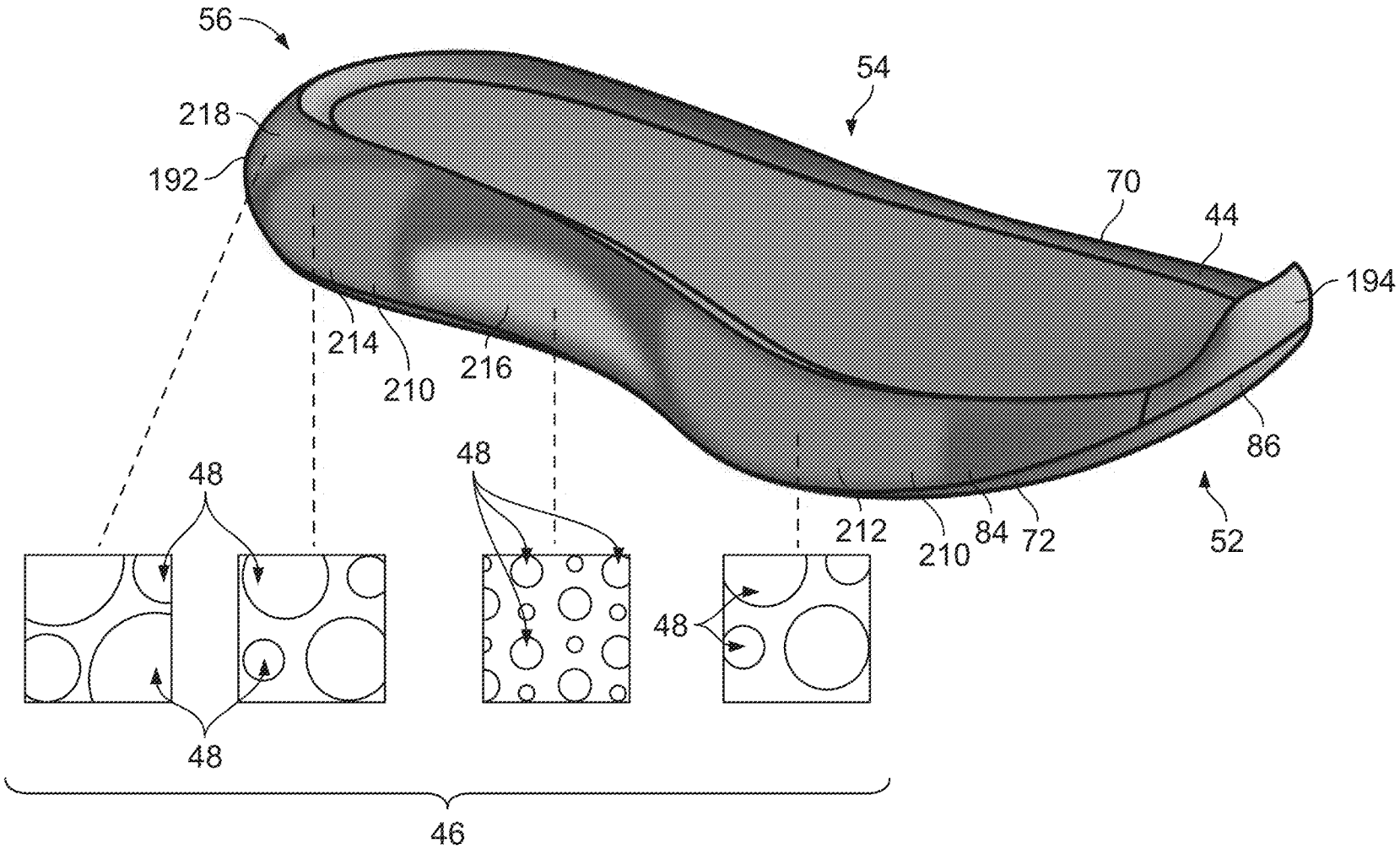
FIG. 11 is an isometric view of the sole structure of FIG. 10 highlighting the various zones of the sole structure.

The three zones, i.e., the first zone 210 the second zone 216, and the third zone 218, each have distinct properties and have different forces applied thereto. Because different forces are applied to different zones within the sole structure 44, different dampening structures are required to maintain a desired feel across the sole structure 44 for a wearer. For example, and referring to FIG. 11, the first portion 212 of the first zone 210 that is disposed within the forefoot region 52 may have increased forces applied thereto. As such, it may be beneficial to provide enhanced stiffening properties to the sole structure 44 that is disposed within the first portion 212. The stiffening properties may be modified by including different sized voids, i.e., small voids, medium voids, and large voids, the large voids being larger than both the small and medium voids, and the medium voids being larger than the small voids. Therefore, a void structure 46 having medium-sized voids 48 (on a comparative or relative basis) therein may be beneficial to include within the first zone 210. Having medium-sized voids 48 within the first portion 212 of the first zone 210 has been found to provide sufficient support within this particular zone and region.

It may be further beneficial to provide enhanced stiffening properties within the second zone 216, and as such, relatively smaller-sized voids 48 may be provided within the second zone 216. The third zone 218, which is disposed entirely within the heel region 56, does not require as much stiffening as other regions. As such, the voids 48 defining the void structure 46 within the third zone 218 may be relatively larger, which provides for relatively less stiffening than in other regions and zones that include smaller voids. Through testing, it has been determined that increasing the size of the voids 48 within any of the zones 210, 216, 218 results in increased compression or deformation of the sole structure 44 within the particular zone, and that reducing the size of the voids 48 increases compression or deformation. As a result, zones or regions of the sole structure 44 that are subject to increased loading or compression may benefit from the inclusion of relatively smaller voids 48 within the particular zone or region.

While the particular embodiments and configurations of various voids 48 and void structures 46 discussed above are discussed with respect to particular configurations, it should be appreciated that the particular arrangement of voids 48, with respect to placement, size, orientation, and shape, may be varied depending on a desired cushioning effect within the sole structure 44. For example, sole structures comprise a variety of materials and thicknesses, and as a result, each sole structure has forces applied thereto in different ways. The void structures 46 disclosed herein are intended to allow for programmable deformation of a sole structure, depending on the characteristics of each particular sole structure, and may be varied from sole structure to sole structure. The present disclosure contemplates that the void structures 46 discussed herein may include voids 48 that comprise one or more of the aforementioned shapes, that comprise alternating shapes or are disposed in alternating configurations, or that vary in size within the various zones or regions of the sole structure 44.

Figure 12A:
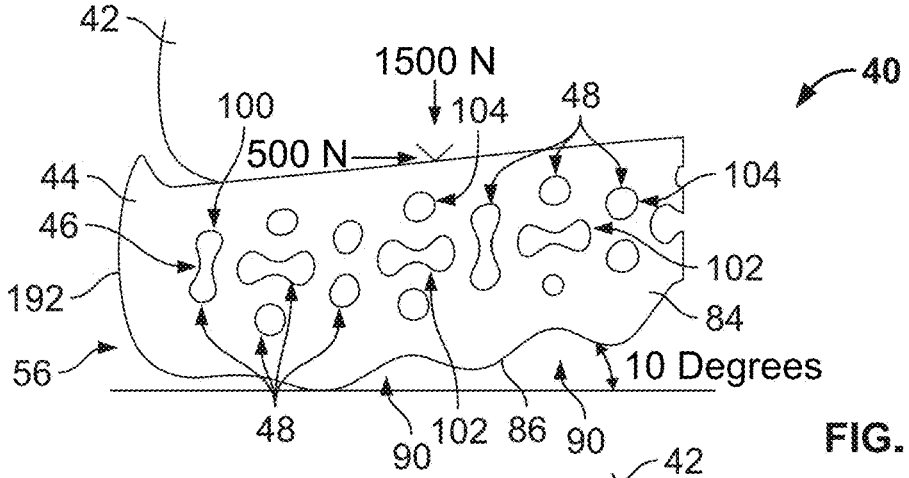
FIGS. 12A-12E illustrate another sole structure having a void structure, the sole structure having a force applied thereto transitioning from FIG. 12A to 12E.
Figure 12B:
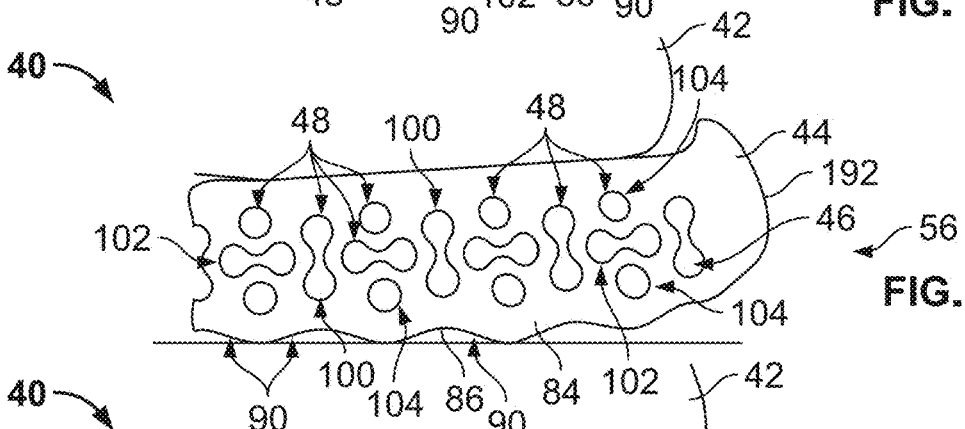
Figure 12C:
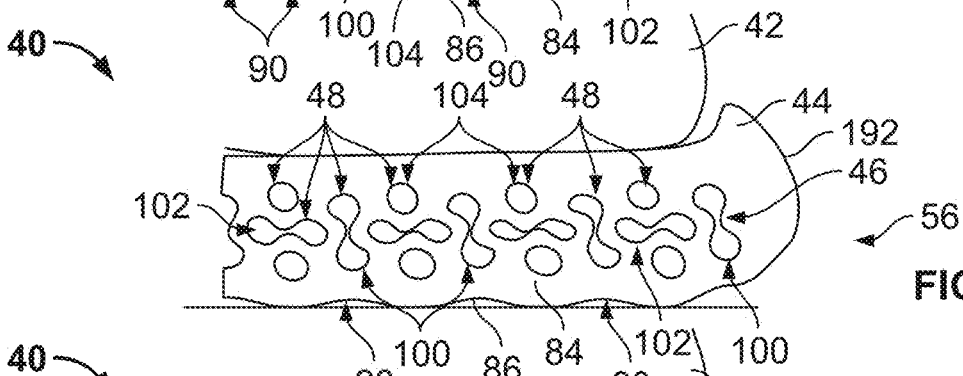
Figure 12D:
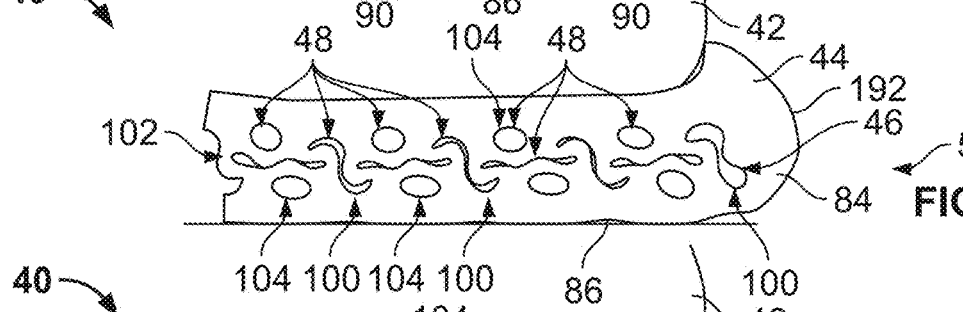
Figure 12E:
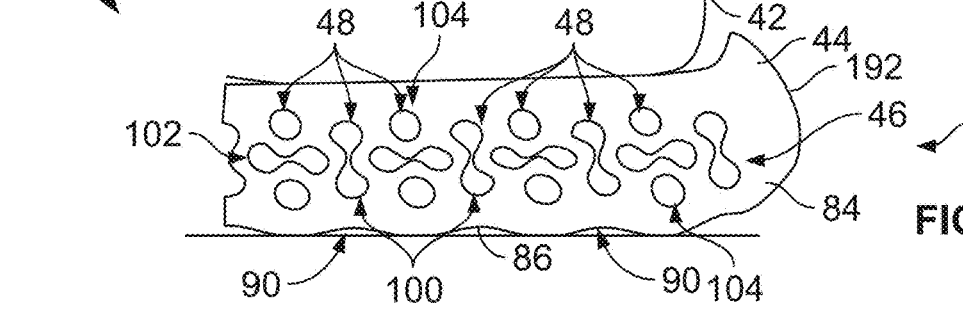

FIGS. 12A-12E illustrate another embodiment of the sole structure 44, which includes another void structure 46 that includes voids of different shapes and configurations. In particular, FIGS. 12A-12E highlight the sole structure 44 transitioning from an uncompressed state in FIG. 12A, immediately before full contact with the ground, to a fully compressed state in FIG. 12D, after full compression has occurred. The example illustrates the compression of the sole structure 44 when a downward force of 1,500 N is applied, and a horizontal force of 500 N is applied. FIG. 12E illustrates the sole structure 44 after the load has been removed from the sole structure 44, i.e., before taking another step. The sole structure shown in FIGS. 12A-12E includes a plurality of first voids 100, a plurality of second voids 102, and a plurality of third voids 104. The first voids 100 are in the shape of vertically disposed lemniscates, while the second voids 102 are in the shape of horizontally disposed lemniscates. The third voids 104 are circular, and are disposed on the top and bottom of the second voids 102. Because of the lemniscate shape of the first voids 100 and the second voids 102, these voids 48 may be characterized as having two lobes at opposing ends thereof.

Still referring to FIGS. 12A-12E, the first voids 100 and the second voids 102 are shown alternating in a direction from the heel end 192 of the sole structure 44 toward the forefoot region (not shown). The third voids 104 are disposed above and below the second voids 102. As a result, the first voids 100 alternate with groups of the second voids 102 and the third voids 104. Because of the lobed nature of the first voids 100 and the second voids 102, and referring to FIG. 12D, the sole structure 44 compresses downward, and slightly forward, thereby compressing the first voids 100 and the second voids 102, resulting in some shear in the horizontal direction. Due to the circular nature of the third voids 104, these voids 48 do not compress as much as the first voids 100 and the second voids 102, thereby providing enhanced stability to the sole structure 44. The circular voids 48 may be provided in lieu of the vertical lemniscate-shaped voids within zones or regions of the sole structure 44 to reduce compression along various portions of the sole structure 44.

Figure 13:
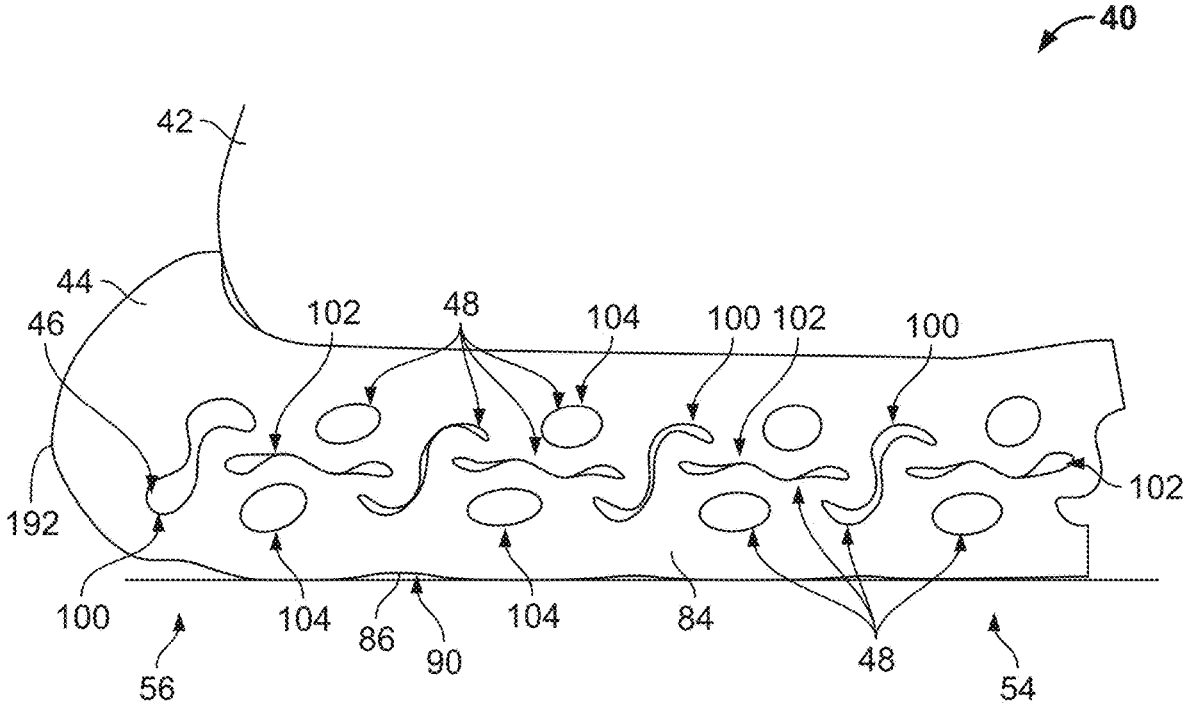
FIG. 13 illustrates yet another sole structure having a void structure having a plurality of voids, the sole structure being in a compressed state.
Figure 14:
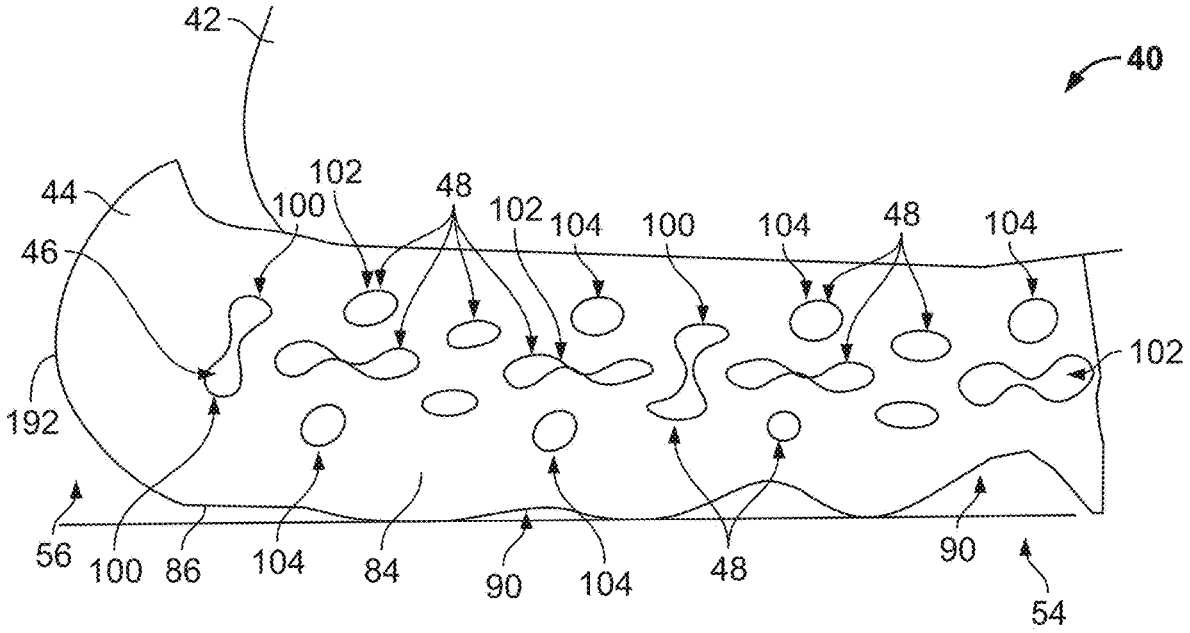
FIG. 14 illustrates still another sole structure having a void structure comprising a plurality of voids, the sole structure being in a compressed state.

While a certain amount of shear and over-compression of the sole structure 44 may be desirable, the sole structures 44 of FIGS. 13 and 14 illustrate how shear can be reduced by reducing the size of some of the voids 48, and by including additional circular or third voids 104. FIG. 13 includes a void structure 46 having similar characteristics as the void structure 46 shown in FIGS. 12A-12E; however, FIG. 14 includes a void structure 46 comprising circular or third voids 104 in place of some of the vertical lemniscate-shaped or first voids 100. The void structure 46 of FIG. 13 includes the first voids 100 alternating with the second voids 102, and the third voids 104 disposed above and below the second voids 102. The void structure 46 of FIG. 14 differs from the void structure 46 of FIG. 13 in that some of the first voids 100 are replaced with vertically aligned pairs of third voids 104.

As a result, moving from the heel end 192 toward the midfoot region 54, the void structure 46 of FIG. 14 includes a repeating pattern having a first column that includes one of the first voids 100, a second column that includes one of the second voids 102 and two of the third voids 104 disposed above and below, and a third column that includes two of the third voids 104 disposed in a vertical configuration. After the third column that includes the vertically disposed third voids 104, the pattern begins again with the vertically aligned lemniscate, i.e., the first void 100. Comparatively, through finite element analyses it has been determined that the void structure 46 shown in FIG. 14 may prevent shear and over compression when compared with the void structure 46 of FIG. 13.

To that end, FIG. 14 illustrates a sole structure 44 having optimized shear and compression characteristics. When a downward force is applied, the sole structure 44 of FIG. 14 exhibits a shear force that is distributed across the pairs of vertically spaced circular or third voids 104, which act to lock and stiffen the sole structure 44. As is evident by a comparison of FIGS. 13 and 14, it may be beneficial to include voids that provide for increased shear or compression within certain areas of the sole structure 44, while including voids that provide for less shear or compression within other portions of the sole structure 44. These and other considerations have been taken into account to achieve a sole structure that includes enhanced cushioning features, as shown above in FIG. 1 and as discussed hereinafter below.

Figure 15:
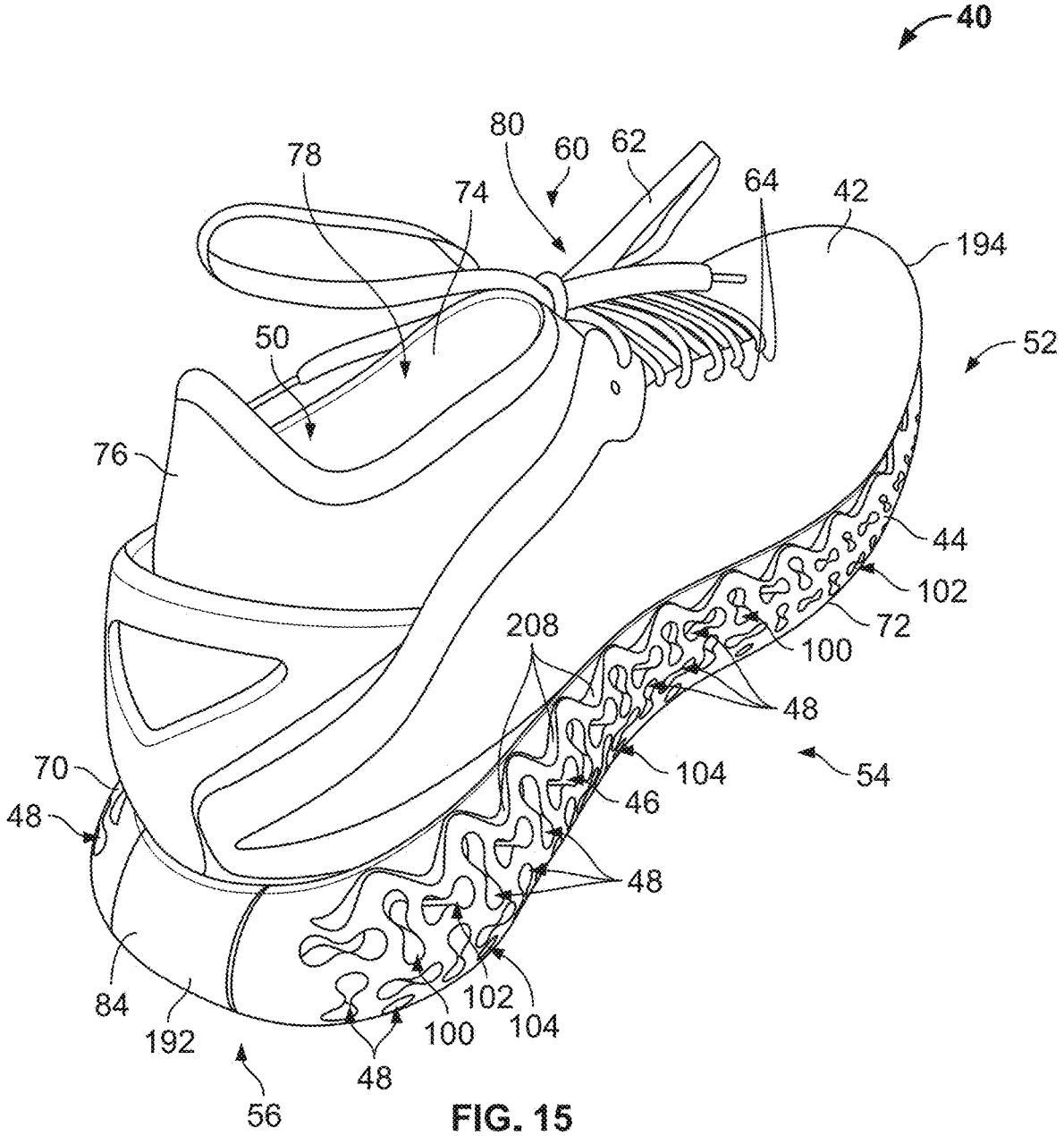
FIG. 15 illustrates a rear perspective view of a shoe with a sole structure having a void structure in accordance with the present disclosure.
Figure 16A:
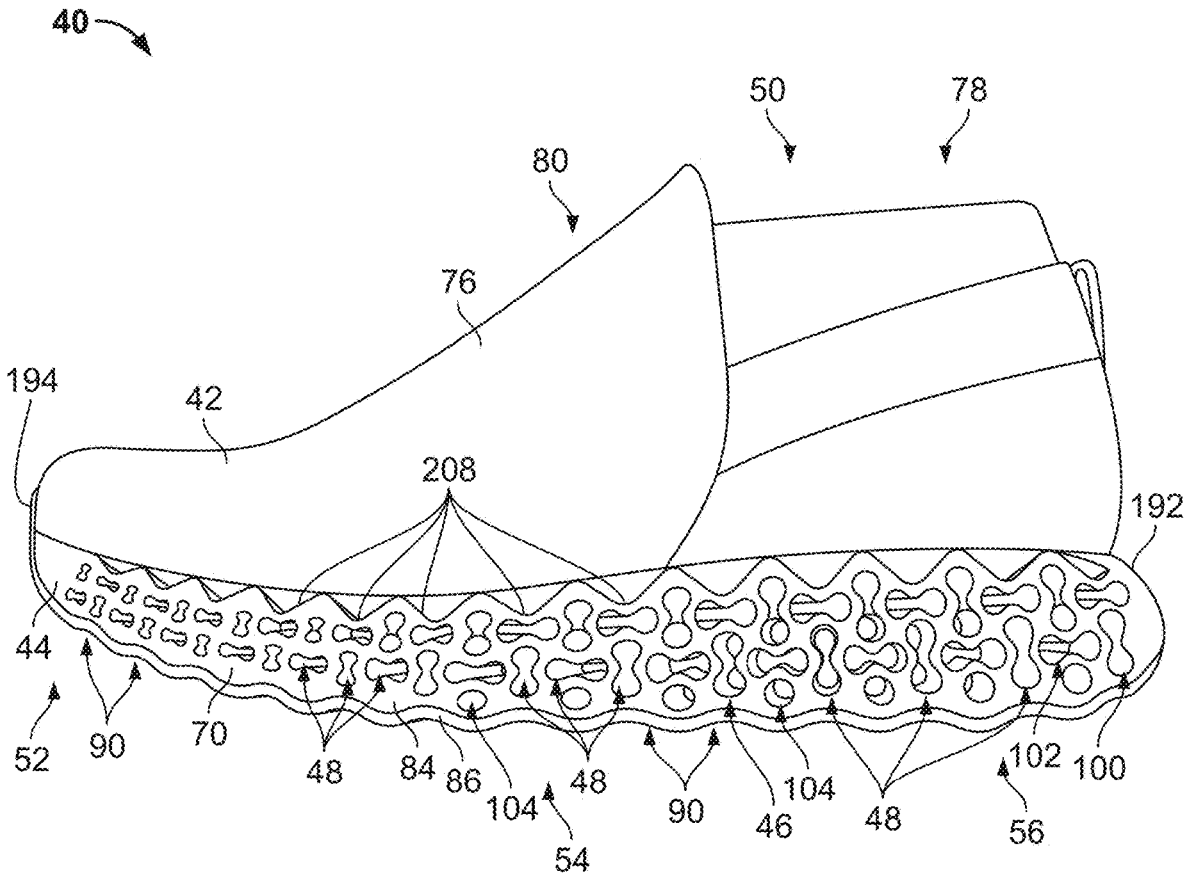
FIGS. 16A-16F illustrate various views of the sole structure of FIG. 15 with varying void structures therein.
Figure 16B:
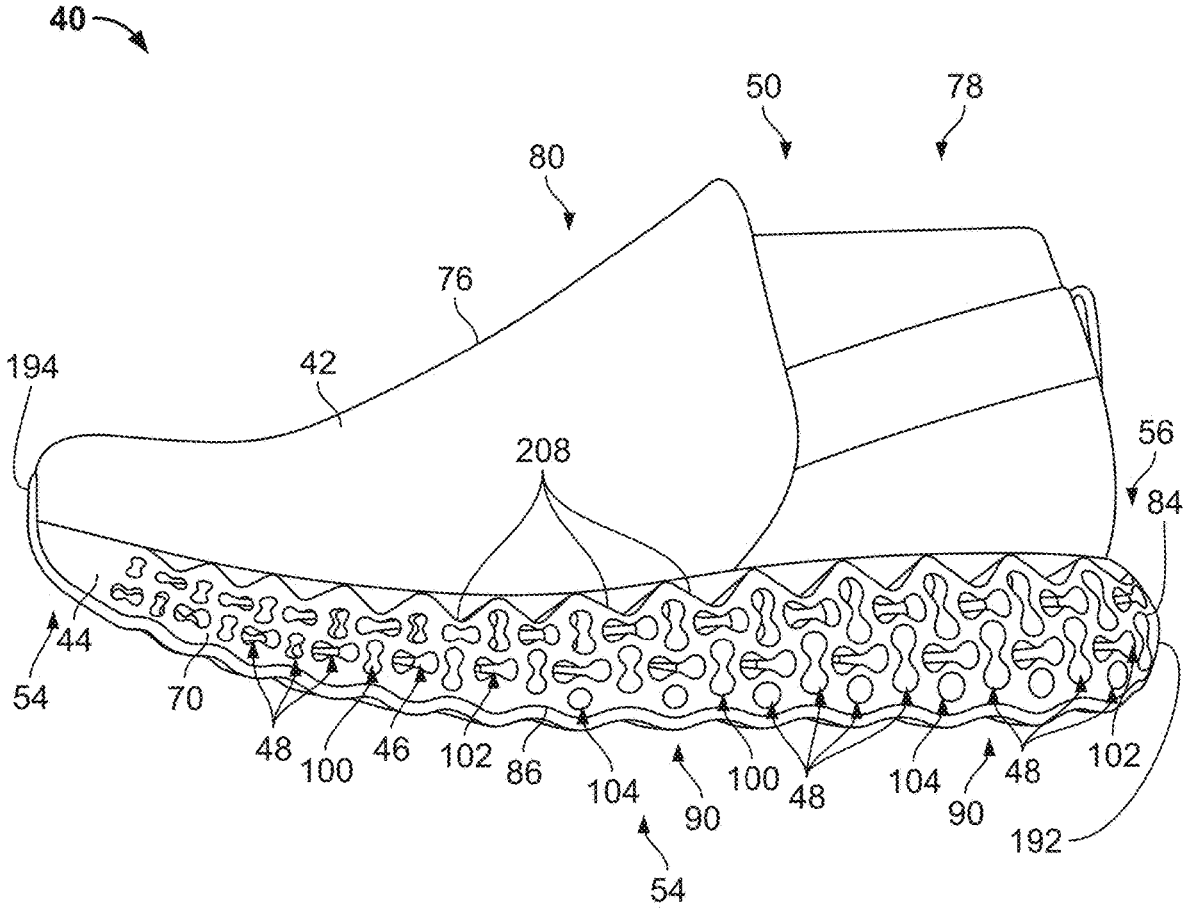
Figure 16C:
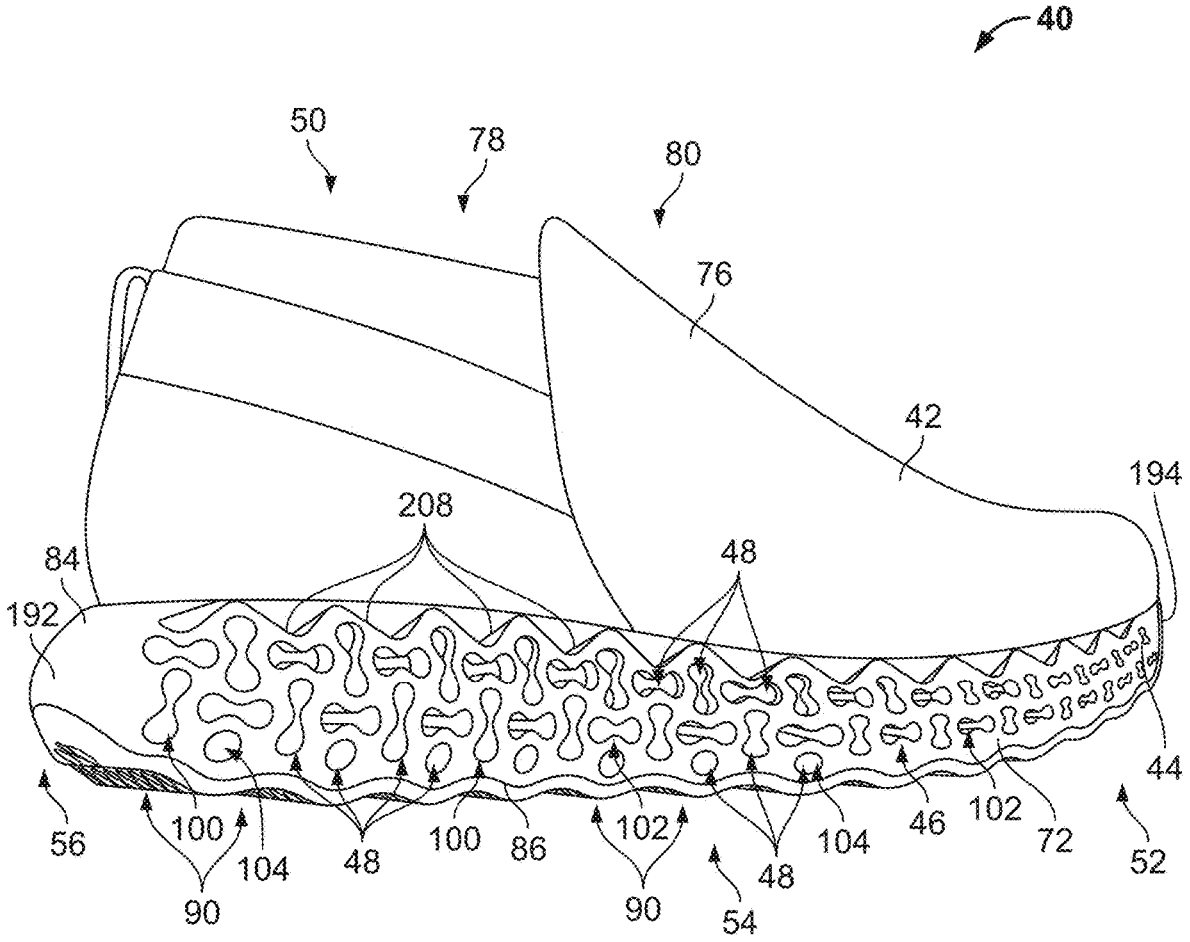
Figure 16D:
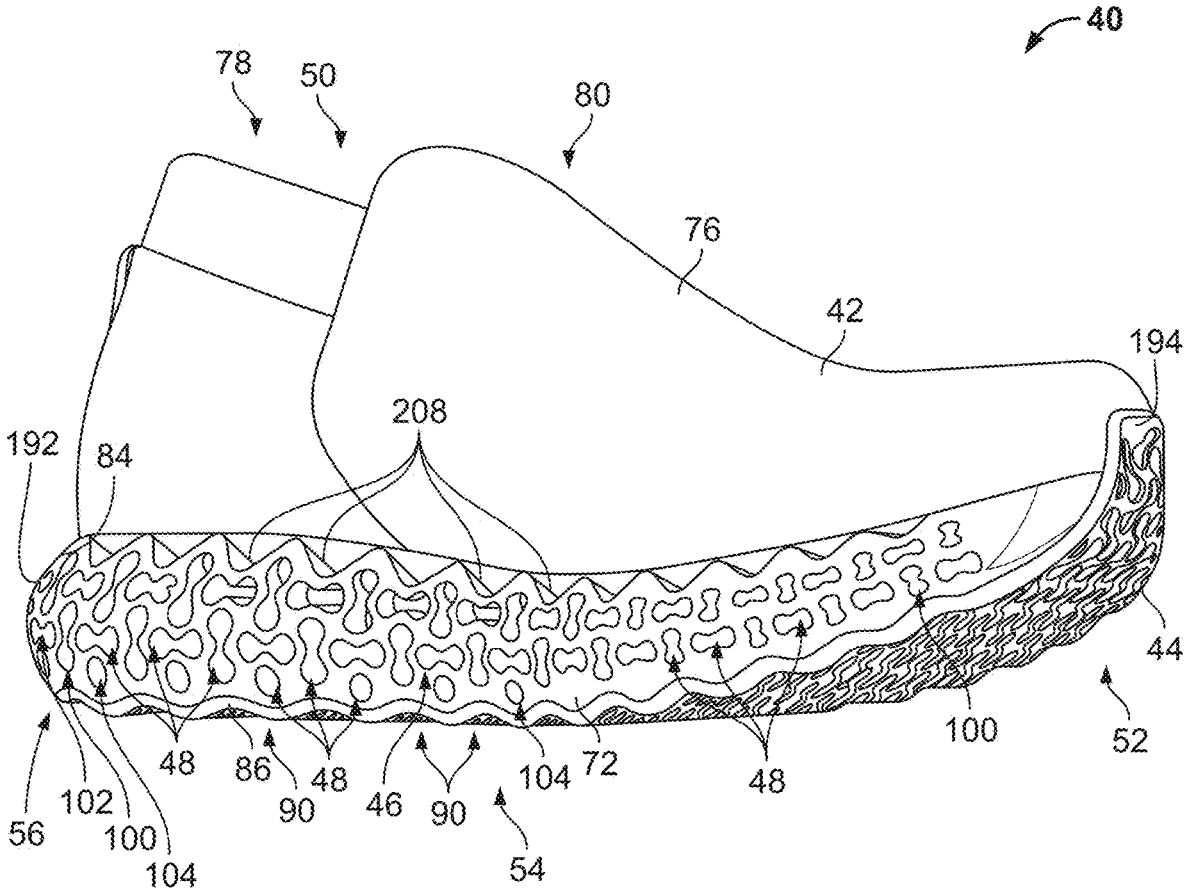
Figure 16E:
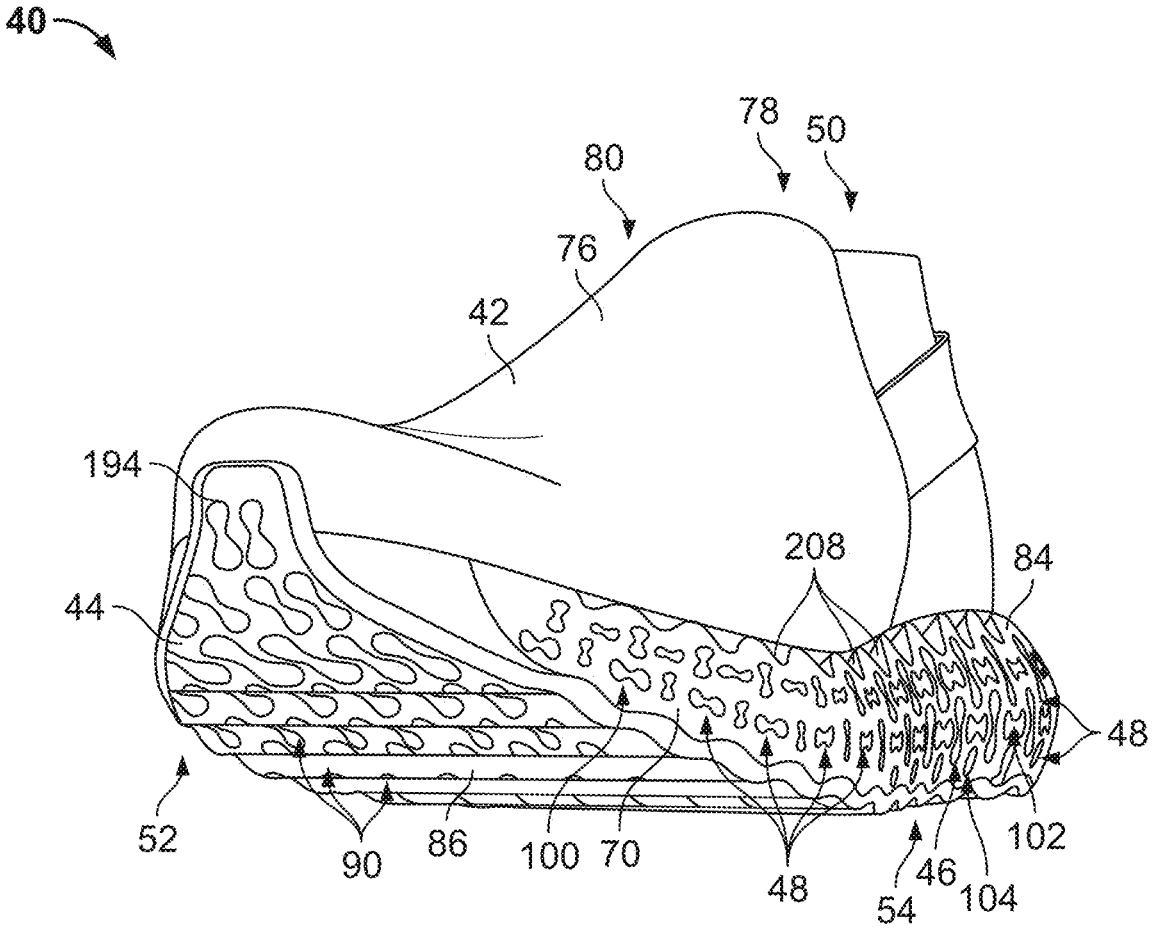
Figure 16F:
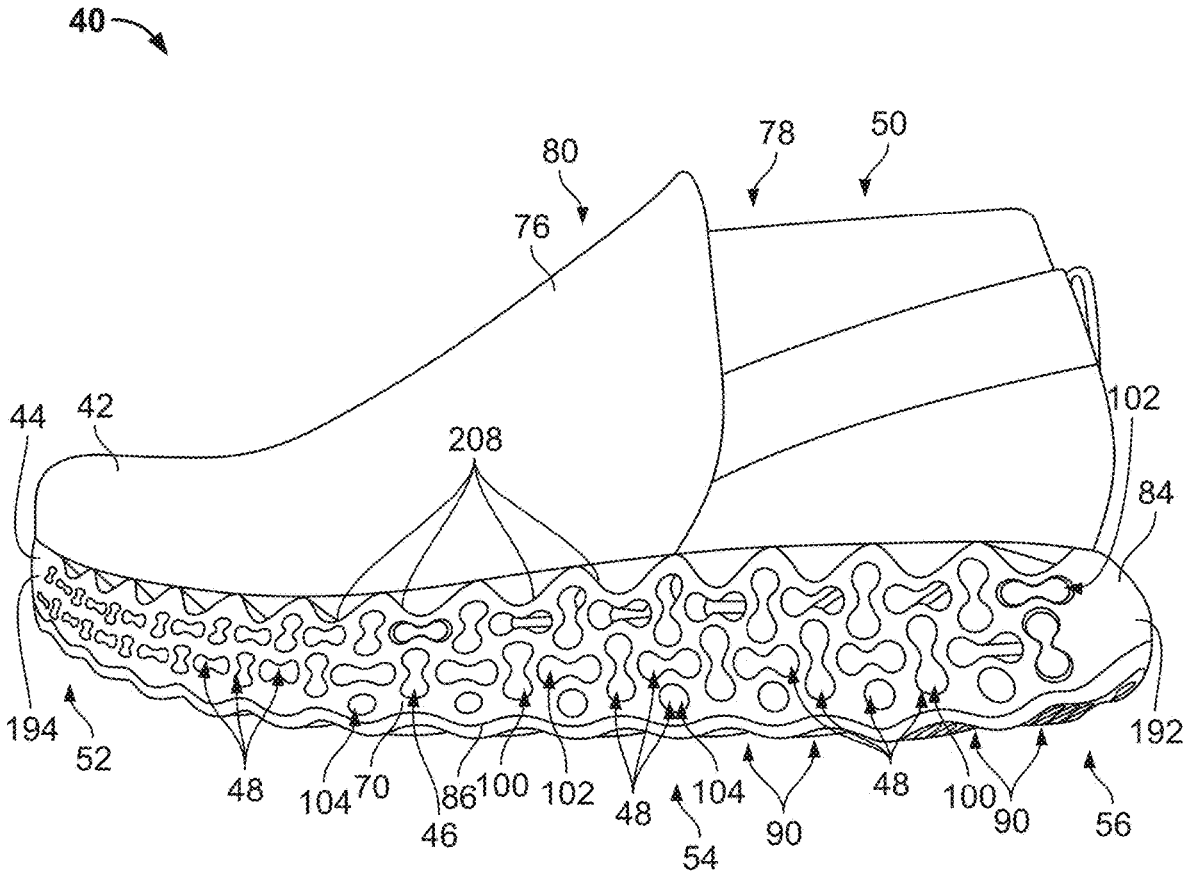

FIG. 15 illustrates a rear perspective view of an article of footwear 40 formed as a shoe having a sole structure 44 with a void structure 46 that comprises varying sized and oriented voids 48. The sole structure 44 of FIG. 15 includes the first voids 100, i.e., vertically disposed lemniscate-shaped voids, second voids 102, i.e., horizontally disposed lemniscate-shaped voids, and third voids 104, i.e., circular shaped voids. The shoe 40 includes an alternating pattern that includes combinations of the first void 100, the second void 102, and the third void 104. For example, moving from the heel end 192 toward the forefoot region 52, the void structure 46 includes a first column of voids having one of the second voids 102 disposed above one of the first voids 100. The second column of voids 48 from the heel includes one of the first voids 100 disposed above one of the second voids 102, and one of the third voids 104 disposed below the second void 102. The third column from the heel includes one of the second voids 102 disposed above one of the first voids 100. The fourth row from the heel includes one of the first voids 100 disposed above one of the second voids 102, which is further disposed above one of the third voids 104.

Still referring to FIG. 15, the void structure 46 includes voids having different configurations and sizes within the forefoot region 52 of the sole structure 44. For example, within the forefoot region 52 various columns do not include any of the third voids 104. To that end, within the forefoot region 52, the columns of voids only include alternating first voids 100 and second voids 102, i.e., a first void 100 disposed above a second void 102 that is adjacent a second void 102 disposed above a first void 100. Further, the first voids 100 and the second voids 102 are relatively smaller within the forefoot region 52 than within the midfoot region 54 and the heel region 56. A plurality of undulating grooves 208 are provided at an upper end of the sole structure 44, which form a plurality of peaks and valleys. FIGS. 16A-16F illustrate the sole structure of FIG. 15 in greater detail with a generic upper shown attached thereto. The sole structure 44 of FIGS. 16A-16F allows for simplified fabrication and manufacturing.

Referring specifically to FIGS. 16A-16F, the sole structure 44 is shown in a variety of configurations. The void structure 46 within the sole structure 44 includes three rows of voids 48 within the heel region 56 and the midfoot region 54, and includes two rows of voids 48 within the forefoot region 52. While the void structure 46 is shown having 26 columns of voids 48, more or fewer voids 48 may be included therein. For example, the void structure 46 may include between 10 columns of voids 48 and 40 columns of voids 48, or between 15 columns of voids and 35 columns of voids, or between 20 columns of voids and 30 columns of voids. The grooves 208 and notches 90 of the midfoot region 54 are shown in detail, which may be provided for added flexibility or compressibility of the sole structure 44. While a generic upper 42 is shown in FIGS. 16A-16F, any number of upper types may be included with the sole structure 44 shown therein.

Figure 17:
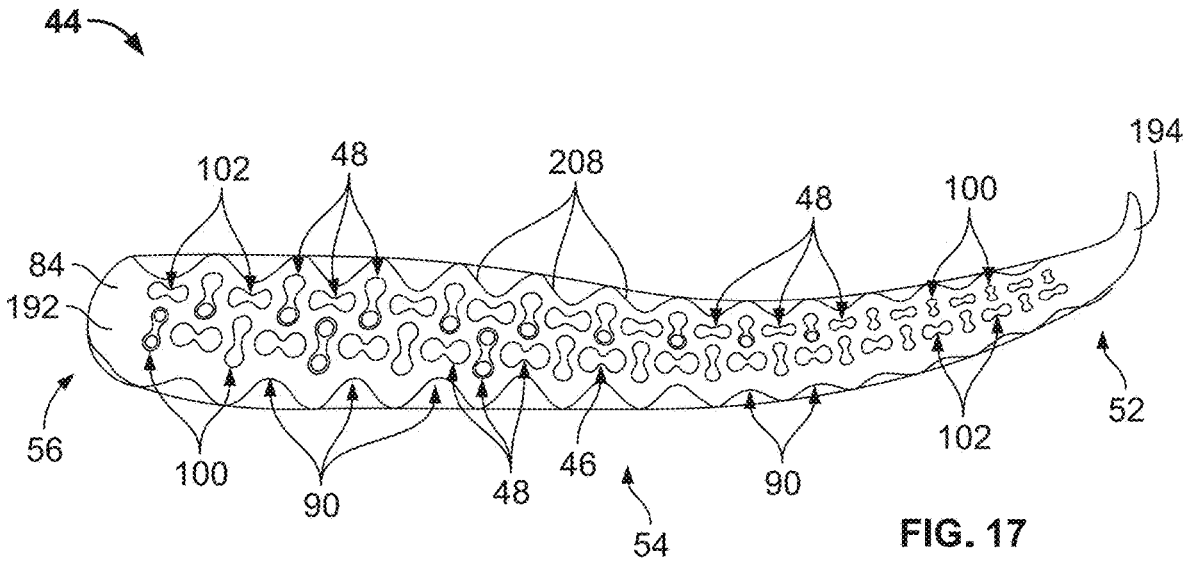
FIG. 17 is a side elevational view of yet another sole structure having a void structure comprising a plurality of voids.

FIG. 17 is a side elevational view of yet another sole structure having varying void structures therein. FIG. 17 includes a void structure that only includes the first voids 100 and the second voids 102, as discussed above within FIGS. 15-16F. Still further, the void structure 46 only includes two rows of voids 48, however, it includes twenty-six columns of the voids 48. To that end, only lemniscate shaped voids are included within the sole structure of FIG. 17. The void structure 46 may include one row of voids, or may include two rows of voids, or may include three rows of voids, or may include four rows of voids, or may include five rows of voids, or may include six rows of voids. The void structure 46 may include between ten and forty-five columns of voids, or between fifteen and forty rows of voids, or between twenty and thirty-five rows of voids, or between twenty-five and thirty rows of voids. The first voids 100 and the second voids 102 are larger within the midfoot region 54 of the sole structure 44 than along the forefoot region 52 of the sole structure 44.

Figure 18A:
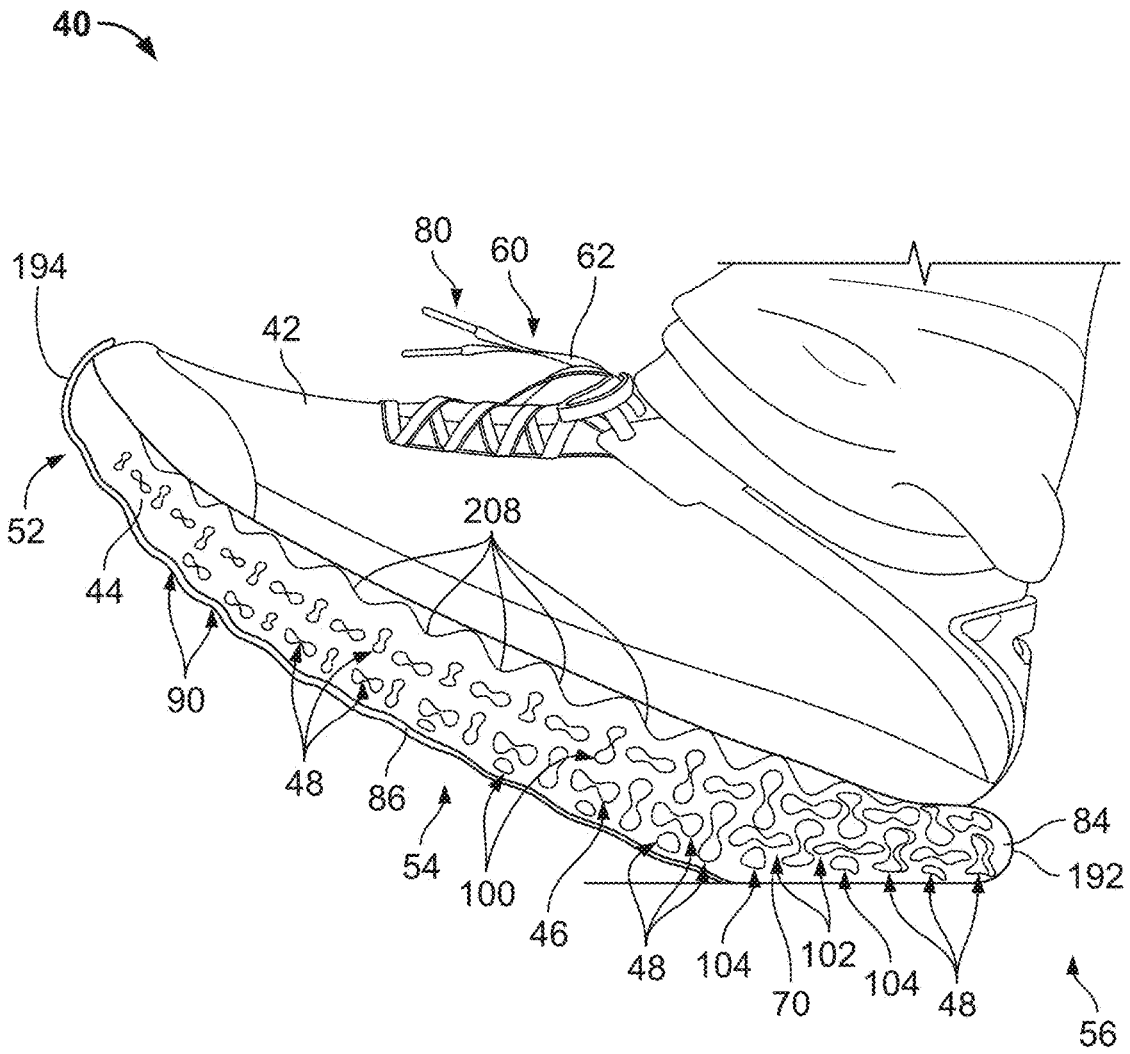
FIGS. 18A-18D illustrate the shoe of FIG. 15 on the foot of a wearer during a forward step.
Figure 18B:
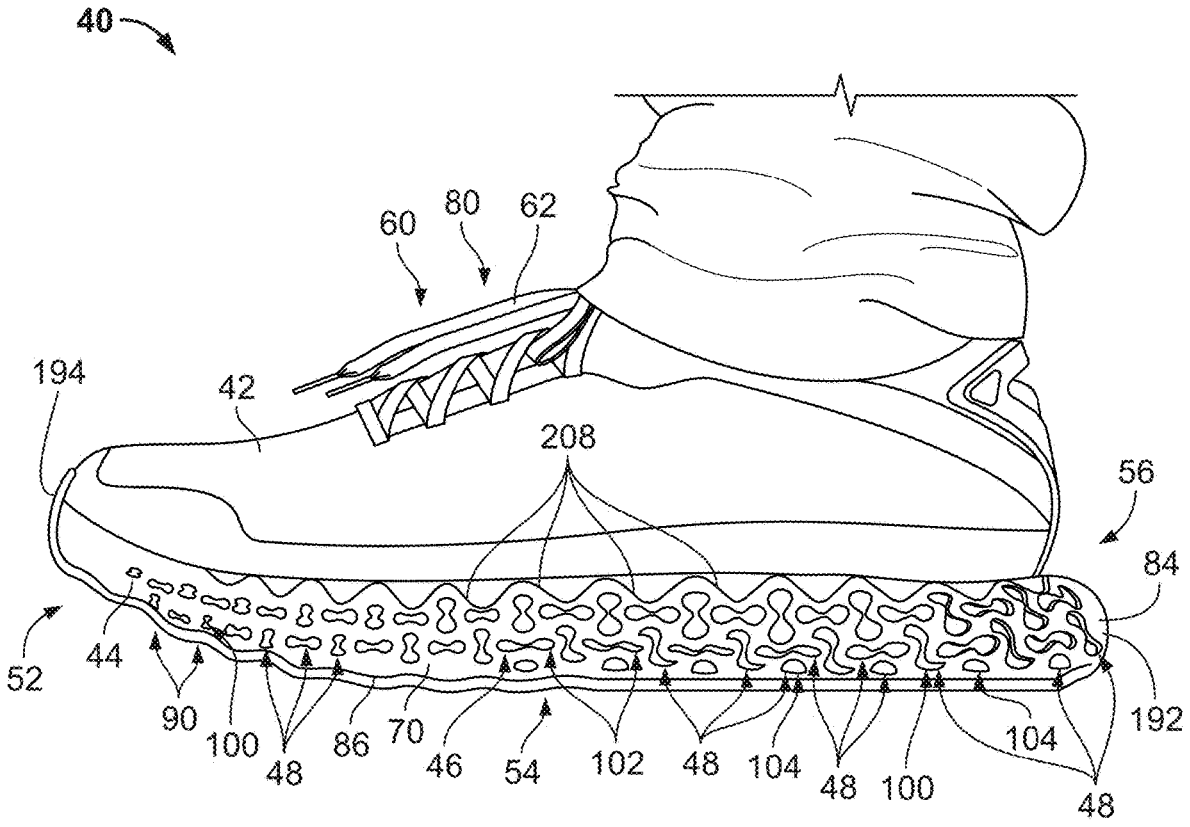
Figure 18C:
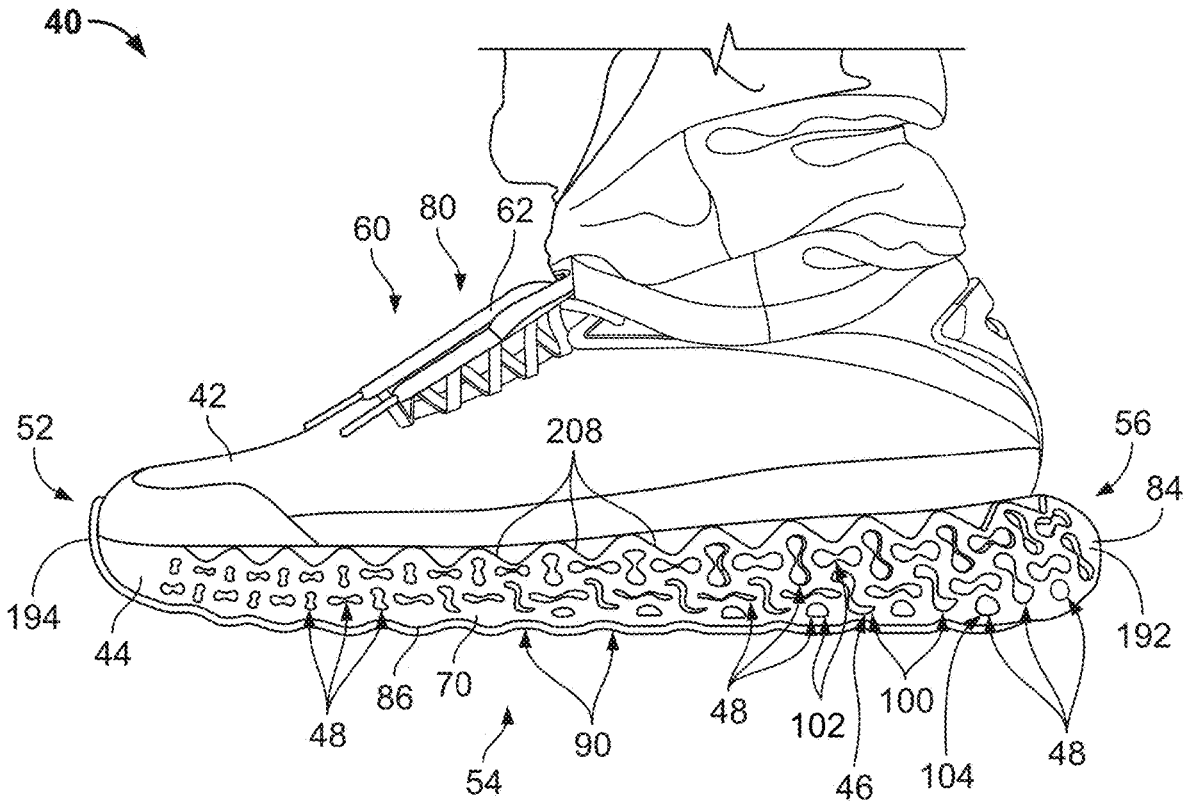
Figure 18D:
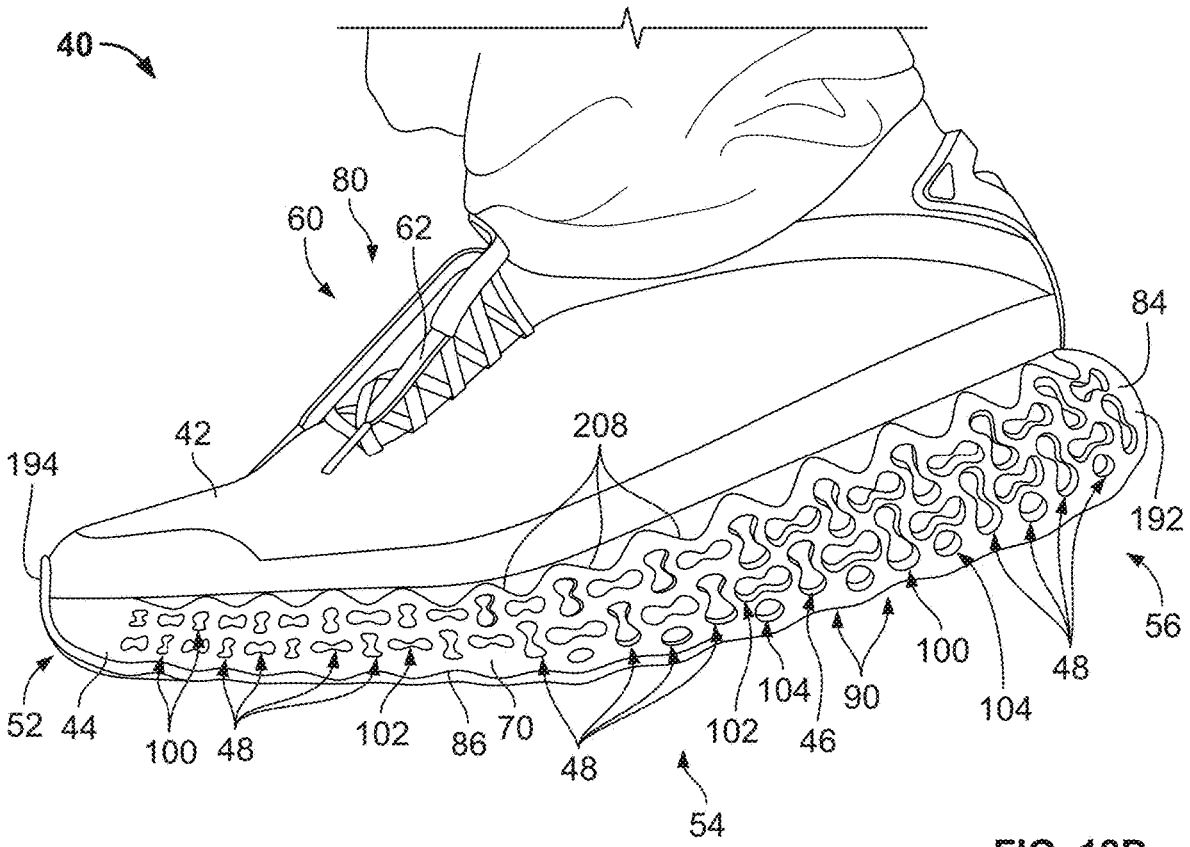

FIGS. 18A-18D illustrate the shoe 40 of FIG. 15 on the foot of a wearer during a forward step. FIG. 18A illustrates an initial impact of the shoe 40 on a ground surface, and illustrates the compression of the various voids that comprise the void structure 46. More specifically, the first voids 100 and the second voids 102 that are within the heel region 56 are shown being compressed in FIG. 18A, while the voids 48 comprising the void structure 46 within other portions of the sole structure 44 are not compressed. After the outsole 86 has contacted the ground surface, various first voids 100, i.e., vertically disposed lemniscate voids, are shown in a compressed state. The first voids 100 that are compressed are generally within the heel region 56, and a portion of the midfoot region 54. In FIG. 18C, additional voids are shown compressed, such as the first voids 100 that are disposed within the midfoot region 54. In FIG. 18D, the first voids 100 and the second voids 102 within the forefoot region 52 are slightly compressed as a force is applied by the wearer to push off the ground surface, thereby taking a step.

Figure 19:
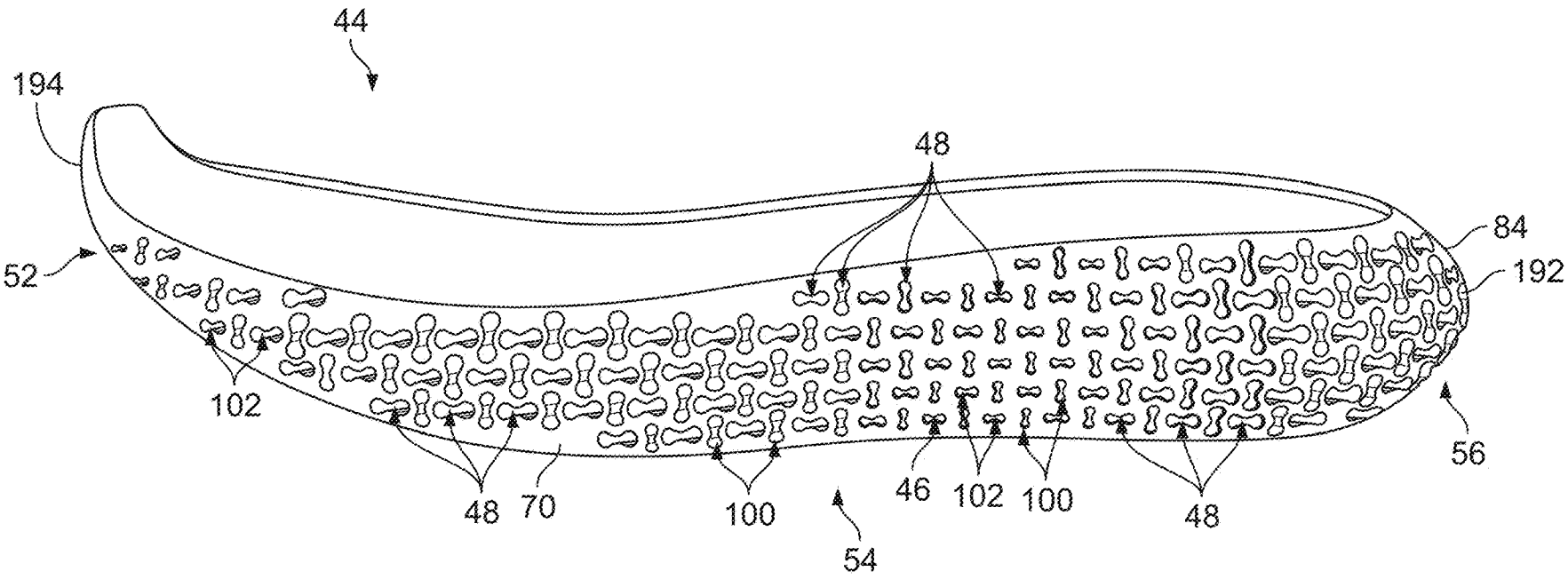
FIG. 19 is a side view of an alternative sole structure according to the present disclosure.
Figures 20, 21:
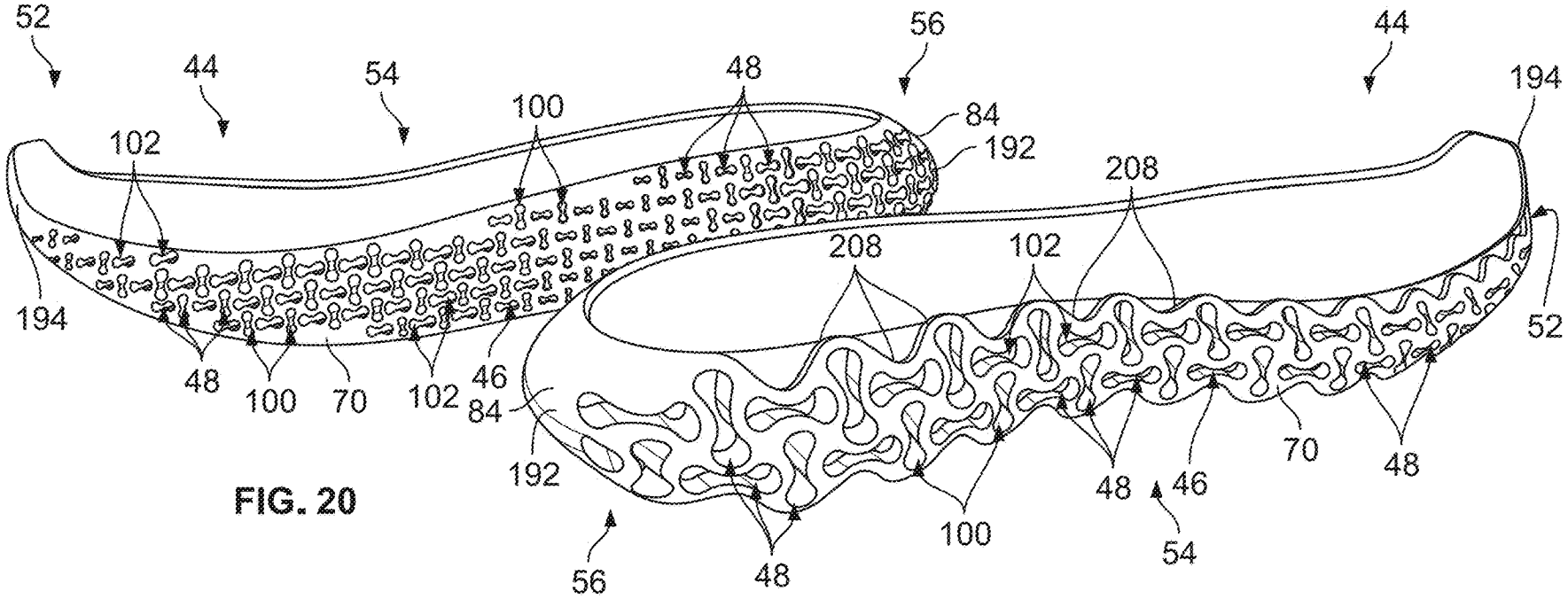
FIG. 20 is a side view of yet another alternative sole structure according to the present disclosure.
FIG. 21 is a side view of still another alternative stole structure according to the present disclosure.

FIGS. 19-21 depict alternative embodiments of the sole structure, which includes alternative configurations of the first voids 100 and the second voids 102. Referring to FIG. 19, a side view of an alternative sole structure 44 is shown. The sole structure 44 of FIG. 19 includes at least four different sizes of the first voids 100 and the second voids 102. The largest voids of the void structure 46 are located within the heel region 56 and the forefoot region 52, while the smallest of the voids are located within the midfoot region 54. Larger voids are also provided within the portions of the forefoot region 52 and the midfoot region, and smaller voids are also provided within the forefoot region 52. To that end, the voids 48 of the void structure 46 progressively increase and decrease in size moving from the heel end 192 to the forefoot region 52.

The sole structures of FIGS. 20 and 21 further highlight void structures 46 that include alternating combinations of the first void 100 and the second void 102. FIG. 20 includes relatively smaller voids across the void structure 46 defined therein compared with the voids 48 within the sole structure of FIG. 21. More specifically, FIG. 20 includes smaller voids 48 located between the heel region 56 and the midfoot region 54 than within other regions. FIG. 21 includes relatively larger voids than shown in any of the above embodiments, with the largest of the voids being within the heel region 56. The voids 48 progressively get smaller moving from the heel end 192 of the sole structure 44 of FIG. 21 to the forefoot region 52.

Any of the embodiments described herein may be modified to include any of the structures or methodologies disclosed in connection with different embodiments. Similarly, materials or construction techniques other than those disclosed above may be substituted or added in some embodiments according to known approaches. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto.

We claim:

1. An article of footwear, comprising:

an upper defining a forefoot region, a midfoot region, and a heel region of the article of footwear; and a sole structure coupled with the upper, the sole structure comprising:

a midsole; and an outsole coupled with a bottom surface of the midsole, wherein a void structure is provided within the midsole of the sole structure, the void structure comprising a plurality of discrete, unconnected voids, which are defined by channels that extend parallel to each other through an entire width of the midsole between a medial side and a lateral side of the sole structure, wherein the void structure includes a plurality of first voids having a first void characteristic and a plurality of second voids having a second void characteristic, the first void characteristic being different than the second void characteristic, and wherein, without external forces on the sole structure, each of the voids of the plurality of first voids and the plurality of second voids have an entirely rounded lemniscate shape.

2. The article of footwear of claim 1, wherein the void structure further includes a plurality of third voids having a third void characteristic that is different than the first void characteristic and the second void characteristic.

3. The article of footwear of claim 2, wherein the plurality of third voids is arranged within at least the midfoot region and the heel region.

4. The article of footwear of claim 2, wherein, without external forces on the sole structure, each void of the plurality of third voids has a shape of a circle.

5. The article of footwear of claim 1, wherein the first void characteristic is an orientation of the plurality of first voids, and the second void characteristic is an orientation of the plurality of second voids, and wherein the orientation of the plurality of first voids is offset 90 degrees from the orientation of the plurality of second voids.

6. The article of footwear of claim 1 further comprising a plurality of grooves defined along an underside of the sole structure.

7. The article of footwear of claim 1, wherein each void of the pluralities of first and second voids that are located in the forefoot region have a size that is smaller than that of each void of the pluralities of first and second voids that are located in the heel region.

8. The article of footwear of claim 1, wherein a size of each void of the pluralities of first and second voids progressively decreases in size moving from the heel region to the forefoot region.

9. The article of footwear of claim 1, wherein the midsole is configured to compress downward and forward.

10. An article of footwear, comprising:

an upper defining a forefoot region, a midfoot region, and a heel region of the article of footwear; and a sole structure coupled with the upper, the sole structure comprising:

a midsole; and an outsole coupled with a bottom surface of the midsole, wherein a void structure is provided within the midsole of the sole structure, the void structure comprising a plurality of discrete voids, unconnected to any other void, which are defined by channels that extend parallel to each other through an entire width of the midsole between a medial side and a lateral side of the sole structure, wherein the void structure includes a plurality of first voids and a plurality of second voids, and wherein, without external forces on the sole structure, each of the voids of the plurality of first voids have a rounded oblong shape and each of the voids of the plurality of second voids have a rounded oblong shape, wherein, with external forces on the sole structure, the midsole compresses in a downward direction and a forward direction, wherein a first void of the plurality of first voids defines a first axis along a largest dimension of the first void, wherein a second void of the plurality of second voids defines a second axis along a largest dimension of the second void, the second void being adjacent to the first void, wherein the first void defines a first end along the first axis and a second end opposite the first end along the first axis, wherein the first void defines a first midpoint between the first end and the second end, wherein the second void defines a third end along the second axis and a fourth end opposite the third end along the first axis, wherein the second void defines a second midpoint between the third end and the fourth end, wherein a width of the first void, measured perpendicular to the first axis, increases between the midpoint and the first end, wherein the first void defines first and second perimeter portions extending between the first end and the second end of the first void on opposite sides of the first axis, wherein the second void defines third and fourth perimeter portions extending between the third end and the fourth end of the second void on opposite sides of the second axis, wherein, with external forces on the sole structure, the first perimeter portion contacts the second perimeter portion between the first midpoint and the first end and between the first midpoint and the second end, and wherein, with external forces on the sole structure, the third perimeter portion contacts the fourth perimeter portion between the second midpoint and the third end and between the second midpoint and the fourth end.

11. The article of footwear of claim 10, wherein the void structure further includes a plurality of third voids.

12. The article of footwear of claim 11, wherein each void of the plurality of third voids has a circular shape.

13. The article of footwear of claim 10, wherein the pluralities of first and second voids define a first column of voids and a second column of voids with the second column of voids being disposed adjacent to the first column of voids, and wherein the first column of voids includes at least one void of the plurality of first voids disposed above at least one void of the plurality of second voids, and the second column of voids includes at least one void of the plurality of second voids disposed above at least one void of the plurality of first voids.

14. The article of footwear of claim 13, wherein the void structure further includes a plurality of third voids, and wherein the first column of voids includes at least one void of the plurality of third voids disposed below the at least one void of the plurality of second voids.

15. The article of footwear of claim 10, wherein the pluralities of first and second voids are relatively smaller in the forefoot region of the sole structure than in the midfoot region of the sole structure.

16. The article of footwear of claim 10 further comprising a plurality of grooves or notches defined along a top or bottom side of the sole structure.

17. The article of footwear of claim 10, wherein each void of the plurality of first voids are larger than each void of the plurality of second voids.

18. The article of footwear of claim 17, wherein the at least one first void and the at least one second void form an auxetic structure.

19. The article of footwear of claim 10, wherein the pluralities of first and second voids define between 10 and 40 columns of voids, inclusive.

20. An article of footwear, comprising:

an upper defining a forefoot region, a midfoot region, and a heel region of the article of footwear; and a sole structure coupled with the upper, the sole structure comprising:

a midsole;

a plurality of wavy grooves defined along an underside of the sole structure; and an outsole coupled with a bottom surface of the midsole, wherein a void structure is provided within the midsole of the sole structure, the void structure comprising a plurality of discrete voids, which are defined by channels that extend parallel to each other through an entire width of the midsole between a medial side and a lateral side of the sole structure, wherein an opening of at least one void of the plurality of voids has a cross-section that uniformly extends along an entire length of the void, wherein the void structure includes at least one first void, at least one second void, and at least one third void, wherein the at least one first void defines a first longitudinal symmetric axis that extends in a first direction along a largest dimension of the first void, the at least one second void defines a second longitudinal symmetric axis that extends in a second direction along a largest dimension of the second void, and the first direction is angularly offset with respect to the second direction, wherein the first void defines a first end along the first longitudinal symmetric axis and a second end opposite the first end along the first longitudinal symmetric axis, wherein the first void defines a midpoint between the first end and the second end, wherein the first void defines a first secondary midpoint between the midpoint and the first end, and a second secondary midpoint between the midpoint and the second end, wherein, without external forces on the sole structure, a width of the first void measured perpendicular to the first longitudinal symmetric axis increases between the midpoint and the first secondary midpoint, wherein, without external forces on the sole structure, a width of the first void, measured perpendicular to the first axis, decreases between the second secondary midpoint and the second end, and wherein the first direction is angularly offset with respect to the second direction by less than 90 degrees.

21. The article of footwear of claim 20, wherein at least some of the voids of the at least one first void and the at least one second void are disposed in rows and columns.

22. An article of footwear, comprising:

an upper defining a forefoot region, a midfoot region, and a heel region of the article of footwear; and a sole structure coupled with the upper, the sole structure comprising:

a single layer midsole; and an outsole coupled with a bottom surface of the midsole, wherein a void structure is provided within the midsole of the sole structure, the void structure comprising a plurality of first voids, a plurality of second voids, and a plurality of third voids, wherein the voids of the plurality of first voids, the plurality of second voids, and the plurality of third voids are each discrete voids, which comprise unconnected channels that extend parallel to each other through an entire width between a medial side and a lateral side of the sole structure, wherein at least some voids of the pluralities of first and second voids define a first column of voids and a second column of voids that is disposed adjacent to the first column of voids, wherein the first column of voids includes at least one void of the plurality of first voids disposed above at least one void of the plurality of second voids and at least one void of the plurality of third voids disposed below at least one void of the plurality of second voids, wherein the second column of voids includes at least one void of the plurality of second voids disposed above at least one void of the plurality of first voids, wherein the plurality of first voids have a first void characteristic and the plurality of second voids have a second void characteristic, the first void characteristic being different than the second void characteristic, and wherein the first void characteristic and the second void characteristic each consist of an orientation.

* * * * *